US010957231B2

(12) United States Patent
Kang

(10) Patent No.: US 10,957,231 B2
(45) Date of Patent: Mar. 23, 2021

(54) DISPLAY APPARATUS

(71) Applicant: LG DISPLAY CO., LTD., Seoul (KR)

(72) Inventor: Gyutae Kang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/559,244

(22) Filed: Sep. 3, 2019

(65) Prior Publication Data

US 2020/0074908 A1 Mar. 5, 2020

(30) Foreign Application Priority Data

Sep. 4, 2018 (KR) ..... 10-2018-0105185

(51) Int. Cl.
*G09G 3/20* (2006.01)

(52) U.S. Cl.
CPC ..... *G09G 3/20* (2013.01); *G09G 2300/0426* (2013.01); *G09G 2300/0452* (2013.01); *G09G 2310/0267* (2013.01); *G09G 2310/0275* (2013.01); *G09G 2310/08* (2013.01)

(58) Field of Classification Search
CPC ..... G09G 3/20; G09G 3/3283; G09G 3/2092; G09G 3/3233; G09G 3/2074; G09G 3/3266; G09G 3/3674; G09G 2300/0452; G09G 2300/0426; G09G 2300/0819; G09G 2310/0275; G09G 2310/08; G09G 2310/0267; G09G 2310/0278; G09G 2310/0297; G09G 2330/021; G09G 2360/18
See application file for complete search history.

(56) References Cited

U.S. PATENT DOCUMENTS

2007/0103421 A1* 5/2007 Sekine ..... G09G 3/3688 345/100
2009/0225009 A1* 9/2009 Ka ..... G09G 3/3283 345/76
2014/0198135 A1* 7/2014 Eom ..... G09G 3/3275 345/690
2016/0078826 A1* 3/2016 Yoo ..... G09G 3/3648 345/691
2019/0189059 A1* 6/2019 Na ..... G09G 3/3291

FOREIGN PATENT DOCUMENTS

KR 10-0947771 B1 3/2010
KR 10-2018-0028889 A 3/2018

* cited by examiner

*Primary Examiner* — Brent D Castiaux
(74) *Attorney, Agent, or Firm* — Birch, Stewart, Kolasch & Birch, LLP

(57) ABSTRACT

A display apparatus is disclosed, which is capable of reducing the number of output channels in a column driving circuit. The display apparatus comprises a display portion including pixels arranged in pixel areas defined by row line groups and column line groups, a row driving circuit configured to supply a scan control signal to the row line groups, a column driving circuit configured to sequentially output a data signal every horizontal period, and a data distribution circuit configured to sequentially supply the data signal, which is sequentially output from each of output channels of the column driving circuit, to the column line groups in accordance with a data selection signal, wherein a period of the data selection signal is longer than 1 horizontal period.

22 Claims, 9 Drawing Sheets

DISPLAY APPARATUS

CROSS-REFERENCE TO RELATED APPLICATIONS

This application claims the priority benefit of the Korean Patent Application No. 10-2018-0105185 filed in the Republic of Korea on Sep. 4, 2018, which is hereby incorporated by reference as if fully set forth herein into the present application.

BACKGROUND

Technical Field

The present disclosure relates to a display apparatus.

Description of the Related Art

Generally, a display apparatus is widely used for a display screen of various apparatuses such as notebook computer, tablet computer, smart-phone, mobile display device, wearable device or portable information device in addition to a display apparatus of a television or monitor.

A related art display apparatus includes a display panel, and a column driving circuit and a scan driving circuit for driving the display panel.

The display panel includes a plurality of sub pixels prepared in every pixel area defined by a plurality of gate lines and a plurality of data lines.

The column driving circuit is connected with the plurality of data lines in one-to-one correspondence through a plurality of data link lines. The column driving circuit supplies a data voltage to the plurality of data lines.

The scan driving circuit is connected with the plurality of gate lines in one-to-one correspondence through a plurality of gate link lines. The scan driving circuit supplies a scan signal to the plurality of gate lines.

Recently, the number of data lines has been increased in accordance with the increase in the size of the display panel and/or the increase of resolution. Meanwhile, the column driving circuit has the limited number of channels so that the display panel requires the increased number of column driving circuits in accordance with the increase in the size of the display panel and/or the increase of resolution.

BRIEF SUMMARY

The present disclosure has been made in view of the above and other problems associated with the related art, and it is an object of the present disclosure to provide a display apparatus which facilitates to reduce the number of output channels in a column driving circuit.

It is another object of the present disclosure to provide a display apparatus which is capable of reducing the number of output channels in a column driving circuit and reducing power consumption.

In accordance with an aspect of the present disclosure, the above and other objects can be accomplished by the provision of a display apparatus comprising a display portion including pixels arranged in pixel areas defined by row line groups and column line groups, a row driving circuit configured to supply a scan control signal to the row line groups, a column driving circuit configured to sequentially output a data signal every horizontal period, and a data distribution circuit configured to sequentially supply the data signal, which is sequentially output from each of output channels of the column driving circuit, to the column line groups in accordance with a data selection signal, wherein a period of the data selection signal is longer than 1 horizontal period.

In accordance with another aspect of the present disclosure, there is provided a display apparatus comprising a display portion including pixels arranged in pixel areas defined by row line groups and column line groups, a row driving circuit configured to supply a scan control signal to the row line groups, a column driving circuit configured to sequentially output a first data signal and a second data signal to the pixels configured to display different color every horizontal period, and a data distribution circuit configured to sequentially supply the first data signal and the second data signal, which are sequentially output from each of output channels of the column driving circuit, to the two column line groups, wherein the second data signal of the (i)th horizontal period (herein, 'i' is a natural number) and the first data signal of the (i+1)th horizontal period are sequentially supplied to the pixels disposed in the different horizontal lines and configured to display the same color, and the data distribution circuit continuously supplies the second data signal of the (i)th horizontal period and the first data signal of the (i+1)th horizontal period to any one of the two column line groups.

According to one or more embodiments of the present disclosure, the display apparatus facilitates to reduce power consumption.

In addition to the objects of the present disclosure as mentioned above, additional objects of the present disclosure will be clearly understood by those skilled in the art from the following description of the present disclosure.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE EMBODIMENTS

Figure 1:
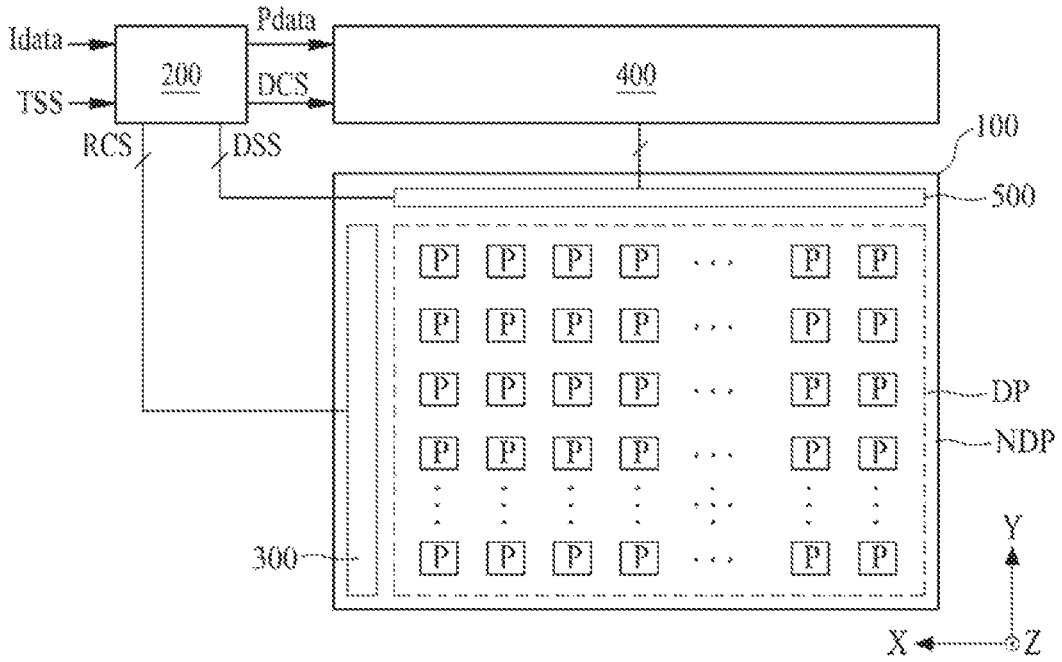
FIG. 1 is a schematic view illustrating a display apparatus according to one embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout the specification. In the following description, when the detailed description of the relevant known function or configuration is determined to unnecessarily obscure the important point of the present disclosure, the detailed description will be omitted.

In a case where 'comprise', 'have', and 'include' described in the present specification are used, another part can be added unless 'only-' is used. The terms of a singular form can include plural forms unless referred to the contrary.

In construing an element, the element is construed as including an error range although there is no explicit description.

In describing a position relationship, for example, when the position relationship is described as 'upon-', 'above-', 'below-' and 'next to-', one or more portions can be arranged between two other portions unless 'just' or 'direct' is used.

In describing a time relationship, for example, when the temporal order is described as 'after-', 'subsequent-', 'next-', and 'before-', a case which is not continuous can be included unless 'just' or 'direct' is used.

It will be understood that, although the terms "first", "second", etc. can be used herein to describe various elements, these elements should not be limited by these terms. These terms are only used to distinguish one element from another. For example, a first element could be termed a second element, and, similarly, a second element could be termed a first element, without departing from the scope of the present disclosure.

The terms "X-axis direction," "Y-axis direction," and "Z-axis direction" should not be interpreted only based on a geometrical relationship in which the respective directions are perpendicular to each other, and can be meant as directions having wider directivities within the range within which the components of the present disclosure can operate functionally.

It should be understood that the term "at least one" includes all combinations related with any one item. For example, "at least one among a first element, a second element and a third element" can include all combinations of two or more elements selected from the first, second and third elements as well as each element of the first, second and third elements.

Features of various embodiments of the present disclosure can be partially or overall coupled to or combined with each other, and can be variously inter-operated with each other and driven technically as those skilled in the art can sufficiently understand. The embodiments of the present disclosure can be carried out independently from each other, or can be carried out together in co-dependent relationship.

Hereinafter, the preferred embodiments of the present disclosure will be described in detail with reference to the accompanying drawings.

FIG. 1 is a schematic view illustrating a display apparatus according to one embodiment of the present disclosure. All components of the display apparatus according to all embodiments of the present disclosure are operatively coupled and configured.

Referring to FIG. 1, the display apparatus according to one embodiment of the present disclosure includes a display panel 100, a timing controller 200, a row driving circuit 300, a column driving circuit 400, and a data distribution circuit 500.

The display panel 100 includes a substrate, a display portion (DP) defined on the substrate, and a non-display portion (NDP) surrounding the display portion (DP).

The substrate corresponds to a base substrate (or base layer), and the substrate includes a plastic material or a glass material. The substrate according to one embodiment of the present disclosure can be a rectangular shape, a rectangular shape having corners rounded with a predetermined curvature, or a non-rectangular shape having at least six sides. For example, the substrate having the non-rectangular shape can include at least one protruding portion or at least one notch portion.

The substrate according to one embodiment of the present disclosure can include an opaque material or a colored polyimide material. For example, the substrate of the polyimide material can be obtained by curing polyimide resin coated at a constant thickness on a front surface of a release layer prepared in a relatively thick carrier substrate. In this case, the carrier glass substrate is separated from the substrate by the release of the release layer through a laser release process. The substrate according to one embodiment of the present disclosure further includes a back plate combined with a rear surface of the substrate with respect to a thickness direction (Z). The back plate maintains a plane state of the substrate. The back plate according to one embodiment of the present disclosure can include a plastic material, for example, polyethylene terephthalate material. The back plate can be laminated in the rear surface of the substrate separated from the carrier glass substrate.

The substrate according to another embodiment of the present disclosure can be a flexible glass substrate. For example, the substrate of the glass material can be a thin film type glass substrate having a thickness of 100 micrometers (μm) or less than 100 micrometers, or can be a carrier glass substrate etched to have a thickness of 100 micrometers (gym) or less than 100 micrometers by a substrate etching process carried out after completing a process of manufacturing the display panel 100.

The display portion (DP) can include pixels (P) arranged in pixel areas defined by row line groups and column line groups.

The row line groups can extend along a first direction (X), and can be separated from each other along a second direction (Y) which is perpendicular to the first direction (X).

The row line groups according to one embodiment of the present disclosure can supply a scan control signal (or gate signal) to the pixels (P) arranged in each horizontal line of the display portion (DP). In this case, one row line group can include the scan control line (or gate line) connected with the pixels (P) arranged in the corresponding horizontal line in common.

The row line groups according to another embodiment of the present disclosure can supply a scan control signal, an emission control signal, and an initialization control signal to the pixels (P) arranged in each horizontal line of the display portion (DP). In this case, one row line group can include a scan control line, an emission control line, and an initialization control line connected with the pixels (P) arranged in the corresponding horizontal line in common.

The row line groups according to another embodiment of the present disclosure can supply a scan control signal and a sensing control signal to the pixels (P) arranged in each horizontal line of the display portion (DP). In this case, one row line group can include a scan control line and a sensing control line connected with the pixels (P) arranged in the corresponding horizontal line in common.

The column line groups according to one embodiment of the present disclosure can extend along the second direction (Y), and can be separated from each other along the first direction (X).

The column line groups according to one embodiment of the present disclosure can supply a data signal to the pixels (P) arranged in each vertical line of the display portion (DP). In this case, one column line group can include a data line connected with the pixels (P) arranged in the corresponding vertical line in common.

The column line groups according to another embodiment of the present disclosure can supply a data signal and a pixel driving voltage to the pixels (P) arranged in each vertical line of the display portion (DP). In this case, one column line group can include a data line and a pixel driving power line connected with the pixels (P) arranged in the corresponding vertical line in common.

The column line groups according to another embodiment of the present disclosure can supply a data signal, a pixel driving voltage, and an initialization voltage to the pixels (P) arranged in each vertical line of the display portion (DP). In this case, one column line group can include a data line, a pixel driving power line, and an initialization voltage line connected with the pixels (P) arranged in the corresponding vertical line in common.

The column line groups according to another embodiment of the present disclosure can supply a data signal, a pixel driving voltage, and a reference voltage to the pixels (P) arranged in each vertical line of the display portion (DP). In this case, one column line group can include a data line, a pixel driving power line, and a reference line connected with the pixels (P) arranged in the corresponding vertical line in common.

The pixels (P) are individually arranged in every pixel area defined on the display portion (DP) of the substrate, respectively, and are electrically connected with the column line and the row line which are configured to pass through the pixel area or configured to be disposed in the periphery of the pixel area.

The pixels (P) according to one embodiment of the present disclosure can be arranged in a stripe structure on the display portion (DP). In this case, one unit pixel can include a red pixel, a green pixel, and a blue pixel, and can further include a white pixel.

The pixels (P) according to another embodiment of the present disclosure can be arranged in a pentile structure on the display portion (DP). In this case, one unit pixel can include at least one red pixel, at least two green pixels, and at least one blue pixel arranged to be adjacent to each other on the plane. For example, one unit pixel having the pentile structure can be provided in such a manner that one red pixel, two green pixels, and one blue pixel are arranged in an octagonal shape on the plane. In this case, the blue pixel can have a relatively larger sized opening area (or emission area), and the green pixel can have a relatively smaller sized opening area.

The non-display portion (NDP) can be prepared along the periphery of the substrate so as to surround the display portion (DP). A pad portion may be prepared at one side of the non-display portion (NDP).

The pad portion is prepared at one side of the non-display portion (NDP) of the substrate, the pad portion is electrically connected with the data distribution circuit 500, and is also electrically connected with the column driving circuit 400.

The timing controller 200 generates pixel data (Pdata) by aligning input video data (Idata) to be appropriate for the driving of the pixels (P) arranged in the display portion (DP) of the display panel 100, and provides the generated pixel data (Pdata) to the column driving circuit 400. For example, the timing controller 200 temporarily stores the input video data (Idata) in at least one line memory or frame memory, aligns the temporarily stored input video data (Idata) by the unit of horizontal line, re-aligns the aligned horizontal line data to be appropriate for the driving of the pixels (P), to thereby generate pixel data (Pdata) by each horizontal line. The timing controller 200 can be provided in a control board or a data printed circuit board.

The timing controller 200 generates a data control signal (DCS) and a data selection signal (DSS) for sequentially outputting the data signal (or analog data signal) to the pixels (P) by each horizontal period on the basis of timing synchronized signal (TSS), and provides the data control signal (DCS) and the data selection signal (DSS) to the column driving circuit 400. For example, the timing controller 200 generates the data control signal (DCS) for driving each horizontal period corresponding to a horizontal synchronized signal of the timing synchronized signal (TSS) in a first time-division period and a second time-division period on the basis of vertical synchronized signal of the timing synchronized signal (TSS) and main clock. And, the timing controller 200 generates the data selection signal (DSS) having a period which is longer than 1 horizontal period based on the horizontal synchronized signal of the timing synchronized signal (TSS) on the basis of the main clock and the vertical synchronized signal of the timing synchronized signal (TSS). In this case, the timing controller 200 generates the data selection signal (DSS) having a period which is longer than 1 horizontal period, and thus reduces transition of the data selection signal (DSS), to thereby reduce power consumption of the display apparatus. For example, a period of the data selection signal (DSS) can be 2 horizontal periods.

The timing controller 200 generates a row control signal (RCS) including a start signal and a plurality of shift clocks so as to supply a row signal to the pixels (P) every 1 horizontal period based on the horizontal synchronized signal of the timing synchronized signal (TSS) on the basis of the main clock and the vertical synchronized signal of the timing synchronized signal (TSS), and provides the row control signal (RCS) to the row driving circuit 300. Herein, the row signal can include at least one among a scan control signal, an emission control signal, an initialization control signal, and a sensing control signal.

The row driving circuit 300 supplies the row signal to the pixels (P) arranged in each horizontal line of the display portion (DP) on the basis of the row control signal (RCS)

provided from the timing controller 200. In this case, the row control signal (RCS) can be supplied to the row driving circuit 300 via at least one corner portion of the substrate and the pad portion.

The row driving circuit 300 according to one embodiment of the present disclosure can be provided at the left side and/or right side of the non-display portion of the substrate in a process of manufacturing a thin film transistor of the pixels (P). For example, the row driving circuit 300 can be formed of a shift register having a plurality of stages electrically connected with the row line groups (RL).

According to one embodiment of the present disclosure, the row driving circuit 300 is provided at the left side of the non-display portion of the substrate, and the row driving circuit 300 can drive the row line groups (RL) connected with the pixels (P) arranged in each horizontal line in accordance with a single feeding method. The single feeding method can be defined as a method for supplying the signal to one end of each of the row line groups (RL).

According to another embodiment of the present disclosure, the row driving circuit 300 is provided at both of left side and right side of the non-display portion of the substrate, and the row driving circuit 300 can drive the row line groups (RL) connected with the pixels (P) arranged in each horizontal line in accordance with a double feeding method. The double feeding method can be defined as a method for supplying the signal to one end and the other end of each of the row line groups (RL) at the same time.

The column driving circuit 400 is electrically connected with the data distribution circuit 500, and can be electrically connected with the timing controller 200. For example, the column driving circuit 400 can be electrically connected with the data distribution circuit 500 via the pad portion prepared in the substrate. And, the column driving circuit 400 can be connected with the timing controller 200 via a data printed circuit board, or can be connected with the timing controller 200 via a data printed circuit board and a control board.

Under the control of the data control signal (DCS) provided from the timing controller 200, the column driving circuit 400 converts the pixel data (Pdata) provided from the timing controller 200 into the analog type data signal on the basis of a plurality of gamma voltages, and then supplies the converted data signal to the data distribution circuit 500 through output channels. In this case, the column driving circuit 400 can sequentially output a first data signal and a second data signal to be supplied to the pixels (P) for displaying different colors every horizontal period. For example, the column driving circuit 400 outputs the first data signal in the first time-division period of each horizontal period, and outputs the second data signal in the second time-division period of each horizontal period.

The column driving circuit 400 can include a digital processing portion for sampling the pixel data (Pdata) provided from the timing controller 200, an analog processing portion for converting the sampling data supplied from the digital processing portion into the analog type data signal for each pixel and outputting the analog type data signal, and a data output portion for supplying the data signal for each pixel supplied from the analog processing portion to the data distribution circuit 500.

The digital processing portion can include a bi-directional shift register for sequentially outputting a data sampling signal in accordance with a source shift clock and a source start signal of the data control signal (DCS), and a latch for sequentially sampling the pixel data (Pdata) for 1 horizontal line in accordance with the data sampling signal sequentially supplied from the bi-directional shift register and simultaneously outputting the sampling data for 1 horizontal line sampled in accordance with a source output enable signal of the data control signal (DCS).

The analog processing portion can include a grayscale voltage generator for outputting a plurality of grayscale voltages corresponding to the number of grayscales in the pixel data on the basis of a plurality of reference gamma voltages, and a digital-to-analog converter for selecting the gray scale corresponding to the sampling data for 1 horizontal line supplied from the digital processing portion as the data signal for each pixel, and outputting the selected data signal for each pixel.

The column driving circuit 400 according to one embodiment of the present disclosure can include a plurality of data integrated circuits having preset output channels. Each of the plurality of data integrated circuits is individually provided in a flexible circuit film, and can be electrically connected with the data distribution circuit 500 through the substrate, the pad portion and the flexible circuit film attached to the pad portion of the substrate. In this case, the row control signal (RCS) can be supplied to the row driving circuit 300 via at least one corner of the substrate, the pad portion, and the first flexible circuit film and/or the last flexible circuit film.

The column driving circuit 400 according to another embodiment of the present disclosure can be provided in the non-display portion at one side of the substrate by a chip on glass method, and can be electrically connected with the pad portion and the data distribution circuit 500.

The data distribution circuit 500 can sequentially supply the data signal for each pixel sequentially provided from each output channel of the column driving circuit 400 to the data line of the column line groups (CL) in accordance with the data selection signal (DSS). In this case, the data distribution circuit 400 can sequentially supply the first data signal and the second data signal, which are sequentially provided from each of the output channels of the column driving circuit 400, to the two column line groups.

The data distribution circuit 500 according to one embodiment of the present disclosure can include input lines and output lines.

The input lines of the data distribution circuit 500 are connected with the output channels of the column driving circuit 400 in one-to-one correspondence.

The output lines of the data distribution circuit 500 are connected with the data lines of the respective column line groups arranged in the display portion (DP). The number of output lines included in the data distribution circuit 500 can be two times larger than the number of input lines included in the data distribution circuit 500. Accordingly, the number of output channels included in the column driving circuit 400 can be determined to be half of the number of data lines.

The data distribution circuit 500 according to one embodiment of the present disclosure can be provided in the non-display portion (NDP) between the display portion (DP) and the pad portion of the substrate. In this case, the data distribution circuit 500 can be provided in the non-display portion at one side of the substrate in the process of manufacturing the thin film transistor of the pixels (P).

The data distribution circuit 500 according to another embodiment of the present disclosure can be provided in each of the plurality of data integrated circuits.

Accordingly, in case of the display apparatus according to one embodiment of the present disclosure, the data signal which is sequentially output from the column driving circuit 400 is distributed to the data lines through the data distribution of the data distribution circuit 500 in accordance with the data selection signal (DSS), whereby the number of output channels in the column driving circuit 400 is reduced to be half of the number of data lines, and the data selection signal (DSS) has the period which is longer than 1 horizontal period, to thereby reduce power consumption.

Figure 2:
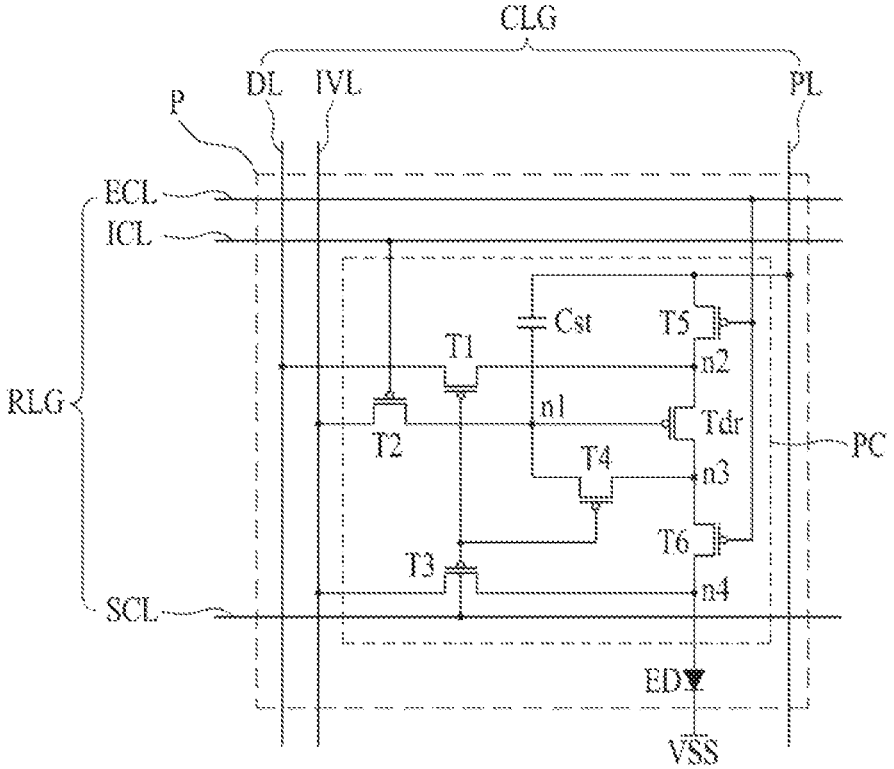
FIG. 2 is an equivalent circuit diagram illustrating one embodiment of the present disclosure shown in FIG. 1.

FIG. 2 is an equivalent circuit diagram illustrating one embodiment of the present disclosure shown in FIG. 1.

Referring to FIGS. 1 and 2, the pixel (P) according to one embodiment of the present disclosure can include a pixel circuit (PC) connected with the row line group (RLG) and the column line group (CLG) for defining the pixel area, and an emission device (ED) connected with the pixel circuit (PC).

The row line group (RLG) can include the emission control line (ECL), the initialization control line (ICL) and the scan control lie (SCL) which are separated from one another while being parallel to one another.

The emission control line (ECL) supplies the emission control signal supplied from the row driving circuit 300 to the pixel circuit (PC).

The initialization control line (ICL) supplies the initialization control signal supplied from the row driving circuit 300 to the pixel circuit (PC).

The scan control line (SCL) supplies the scan control signal supplied from the row driving circuit 300 to the pixel circuit (PC).

The column line group (CLG) can include the data line (DL), the initialization voltage line (IVL), and the pixel driving power line (PL) which are perpendicular to the lines (ECL, ICL, SCL) of the row line groups (RLG) while being parallel to one another.

The data line (DL) can sequentially supply the first data signal supplied in the first time-division period of each horizontal period from the data distribution circuit 500 and the second data signal supplied in the second time-division period of each horizontal period from the data distribution circuit 500 to the pixel circuit (PC).

The initialization voltage line (IVL) according to one embodiment of the present disclosure can supply the initialization voltage, which is supplied from a power supply circuit provided in the control board or data printed circuit board, to the pixel circuit (PC). The initialization voltage line (IVL) according to another embodiment of the present disclosure can supply the initialization voltage, which is supplied from the column driving circuit 400, to the pixel circuit (PC).

The pixel driving power line (PL) according to one embodiment of the present disclosure can supply the pixel driving voltage, which is supplied from the power supply circuit provided in the control board or data printed circuit board, to the pixel circuit (PC). The pixel driving power line (PL) according to another embodiment of the present disclosure can supply the pixel driving voltage, which is supplied from the column driving circuit 400, to the pixel circuit (PC).

Selectively, the pixel driving power line (PL) can be arranged to be shared by two pixel circuits (PC) adjacently arranged along a first direction (X).

The pixel circuit (PC) according to one embodiment of the present disclosure is operated in the order of an initialization period, a sampling period (or sensing period), and an emission period, whereby a data current corresponding to the data signal supplied to the data line (DL) can be supplied to the emission device (ED). In this case, the pixel circuit (PC) can include a driving transistor (Tdr), first to sixth transistors (T1 to T6), and a storage capacitor (Cst). Herein, at least one among the driving transistor (Tdr) and the first to sixth transistors (T1 to T6) can be formed of a P-type (or N-type) thin film transistor (TFT). And, at least one among the driving transistor (Tdr) and the first to sixth transistors (T1 to T6) can be a-Si TFT, poly-Si TFT, oxide TFT, or organic TFT.

The driving transistor (Tdr) can supply a data current corresponding to a gate-source voltage based on the data signal supplied to the data line (DL) to the emission device (ED). The driving transistor (Tdr) according to one embodiment of the present disclosure can include a gate electrode connected with a first node (n1), a first source/drain electrode connected with a second node (n2), and a second source/drain electrode connected with a third node (n3).

The first transistor (T1) is turned-on by the scan control signal, and the first transistor (T1) supplies the data signal, which is supplied from the data line (DL), to the second node (n2). The first transistor (T1) according to one embodiment of the present disclosure can include a gate electrode connected with the scan control line (SCL), a first source/drain electrode connected with the data line (DL), and a second source/drain electrode connected with the second node (n2).

The second transistor (T2) is turned-on by the initialization control signal, and the second transistor (T2) supplies the initialization voltage, which is supplied from the initialization voltage line (IVL), to the first node (n1). The second transistor (T2) according to one embodiment of the present disclosure can include a gate electrode connected with the initialization control line (ICL), a first source/drain electrode connected with the initialization voltage line (IVL), and a second source/drain electrode connected with the first node (n1).

The third transistor (T3) is turned-on by the scan control signal, and the third transistor (T3) supplies the initialization voltage, which is supplied from the initialization voltage line (IVL), to a fourth node (n4). The third transistor (T3) according to one embodiment of the present disclosure can include a gate electrode connected with the scan control line (SCL), a first source/drain electrode connected with the initialization voltage line (IVL), and a second source/drain electrode connected with the fourth node (n4).

The fourth transistor (T4) is turned-on by the scan control signal, whereby the fourth transistor (T4) electrically connects the first node (n1) and the third node (n3) with each other. That is, according as the fourth transistor (T4) is turned-on by the scan control signal, the gate electrode of the driving transistor (Tdr) and the drain electrode of the driving transistor (Tdr) are electrically connected with each other, whereby the driving transistor (Tdr) is connected in a diode shape. The fourth transistor (T4) according to one embodiment of the present disclosure can include a gate electrode connected with the scan control line (SCL), a first source/drain electrode connected with the first node (n1), and a second source/drain electrode connected with the third node (n3). Selectively, the fourth transistor (T4) can include a dual channel structure having 4-1 transistor and 4-2 transistor which are simultaneously turned-on by the scan control signal and are connected with each other in a serial connection type.

The fifth transistor (T5) is turned-on by the emission control signal, and the fifth transistor (T5) supplies the pixel driving voltage to the second node (n2). The fifth transistor (T5) according to one embodiment of the present disclosure can include a gate electrode connected with the emission control line (ECL), a first source/drain electrode connected with the pixel driving power line (PL), and a second source/drain electrode connected with the second node (n2).

The sixth transistor (T6) is turned-on by the emission control signal, to thereby form a current path between the third node (n3) and the fourth node (n4). The sixth transistor (T6) according to one embodiment of the present disclosure can include a gate electrode connected with the emission control line (ECL), a first source/drain electrode connected with the third node (n3), and a second source/drain electrode connected with the fourth node (n4).

The storage capacitor (Cst) stores a differential voltage between the gate electrode of the driving transistor (Tdr) and the source electrode of the driving transistor (Tdr). For example, the storage capacitor (Cst) stores a property compensation voltage of the driving transistor (Tdr) and the data voltage supplied to the first node (n1). The storage capacitor (Cst) according to one embodiment of the present disclosure can include a first capacitor electrode connected with the gate electrode of the driving transistor (Tdr), and a second capacitor electrode overlapped with the first capacitor electrode and supplied with the pixel driving voltage.

The emission device (ED) emits light by the data current supplied from the pixel circuit (PC). The emission device (ED) according to one embodiment of the present disclosure can include a pixel driving electrode (or anode electrode) connected with the pixel circuit (PC), an emission layer provided on the pixel driving electrode, and a common electrode (or cathode electrode) electrically connected with the emission layer.

The pixel driving electrode is disposed on an opening area of the pixel (P), and is electrically connected with the fourth node (n4) of the pixel circuit (PC). The periphery of the pixel driving electrode can be covered by a bank pattern. The bank pattern can be disposed on the remaining areas of the pixel area except the opening area so that the bank pattern can cover the periphery of the pixel driving electrode, to thereby define the opening area of the pixel (P). The bank pattern according to one embodiment of the present disclosure can be defined in a pentile structure or stripe structure.

The emission layer according to one embodiment of the present disclosure includes two or more emission portions for emitting white light. For example, the emission layer according to one embodiment of the present disclosure can include a first emission portion and a second emission portion so as to emit white light by a mixture of first light and second light. Herein, the first emission portion emits the first light, and the first emission portion can include any one among a blue emission portion, a green emission portion, a red emission portion, a yellow emission portion, and a yellowish green emission portion. The second emission portion emits the second light, which is the complementary color to the first light, and can include any one among the blue emission portion, the green emission portion, the red emission portion, the yellow emission portion, and the yellowish green emission portion.

The emission layer according to another embodiment of the present disclosure can include the emission portion configured to emit light exhibiting a color which corresponds to a preset color of the pixel (P) among the blue emission portion, the green emission portion, and the red emission portion. For example, the emission layer according to another embodiment of the present disclosure can include any one among an organic emission layer, an inorganic emission layer, and a quantum dot emission layer, or can include a deposition structure or mixture structure of the organic emission layer (or inorganic emission layer) and the quantum dot emission layer.

The emission layer according to another embodiment of the present disclosure can include a micro emission diode device embodied in an integrated circuit type. The micro emission diode device can include a first terminal electrically connected with the pixel driving electrode, and a second terminal electrically connected with the common electrode.

The common electrode is electrically connected with the emission layer. The common electrode can be provided in the entire display portion (DP) of the substrate so that the common electrode can be connected with the emission layers of the respective pixel areas in common.

An operation of the pixel according to one embodiment of the present disclosure will be described as follows.

First, the pixel (P) according to one embodiment of the present disclosure can be operated by the initial period, the sampling period, and the emission period for every frame.

In the initialization period, the initialization control signal supplied to the initialization control line (ICL) has a transistor-on voltage level, the emission control signal supplied to the emission control line (ECL) has a transistor-off voltage level, and the scan control signal supplied to the scan control line (SCL) has the transistor-off voltage level. Accordingly, for the initialization period, the second transistor (T2) is turned-on by the initialization control signal of the transistor-on voltage level, the initialization voltage supplied to the initialization voltage line (IVL) is supplied to the first node (n1), whereby the storage capacitor (Cst) is initialized to the differential voltage between the initialization voltage and the pixel driving voltage.

In the sampling period, the initialization control signal supplied to the initialization control line (ICL) has the transistor-off voltage level, the emission control signal supplied to the emission control line (ECL) maintains the transistor-off voltage level, and the scan control signal supplied to the scan control line (SCL) has the transistor-on voltage level. Thus, for the sampling period, according as the fourth transistor (T4) is turned-on by the scan control signal of the transistor-on voltage level, the fourth transistor (T4) is electrically connected with each of the first node (n1) and the third node (n3), whereby the driving transistor (Tdr) is connected in the diode type. At the same time, according as the first transistor (T1) is turned-on by the scan control signal of the transistor-on voltage level, the data signal supplied to the data line (DL) is supplied to the second node (n2). For the sampling period, according as a potential of the third node (n3) rises by the current flowing between the second source/drain electrode and the first source/drain electrode of the driving transistor (Tdr) by the voltage of the first node (n1), a potential of the first node (n1) rises to the voltage obtained by subtracting the property voltage of the driving transistor (Tdr) and the voltage in accordance with the data signal from the initialization voltage, and the differential voltage between the gate voltage of the driving transistor (Tdr) and the source voltage of the driving transistor (Tdr) in accordance with the potential of the first node (n1) is stored in the storage capacitor (Cst). In this case, the initialization voltage has the voltage level which is the same as or lower than common power (or cathode voltage) supplied to the common electrode.

In the emission period, the initialization control signal supplied to the initialization control line (ICL) maintains the transistor-off voltage level, the emission control signal supplied to the emission control line (ECL) has the transistor-on voltage level, and the scan control signal supplied to the scan control line (SCL) has the transistor-off voltage level. Accordingly, for the emission period, according as each of the fifth and sixth transistors (T5, T6) is turned-on by the emission control signal of the transistor-on voltage level, the pixel driving voltage supplied from the pixel driving power line is applied to the first source/drain electrode of the driving transistor (Tdr) through the turned-on fifth transistor (T5), whereby the data current in accordance with the voltage difference between the pixel driving voltage and the gate voltage of the driving transistor (Tdr) is supplied to the emission device (ED) through the turned-on sixth transistor (T6). For the emission period, the gate-source voltage (Vgs) of the driving transistor (Tdr) is maintained as "(Vdata−Vth)−Vdd" by the storage capacitor (Cst), and the current flowing in the driving transistor (Tdr) is proportional to the square of value obtained by subtracting a threshold voltage from the source-gate voltage (Vsg) of the driving transistor (Tdr), whereby the current flowing in the emission device (ED) can be determined by the data voltage (Vdata) in accordance with the data signal regardless of the threshold voltage (Vth) of the driving transistor (Tdr). Herein, "Vdata" indicates the voltage level of the data signal, and "Vdd" indicates the pixel driving voltage.

Figure 3:
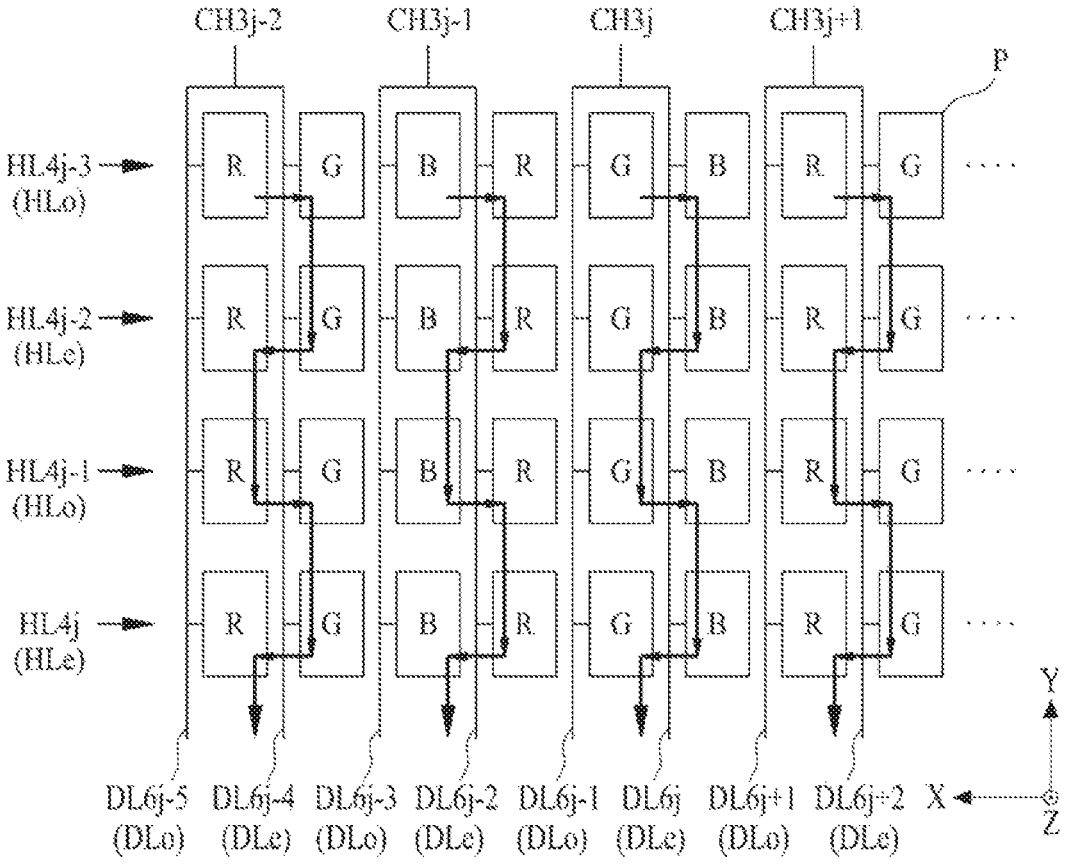
FIG. 3 illustrates an arrangement structure of pixels, an alignment order of pixel data, and a supply order of a data signal according to one embodiment of the present disclosure shown in FIG. 1.

FIG. 3 illustrates an arrangement structure of pixels, an alignment order of pixel data, and a supply order a of data signal according to one embodiment of the present disclosure shown in FIG. 1.

Referring to FIG. 3 in connection with FIG. 1, the pixels (P) according to one embodiment of the present disclosure can include the red pixel (R, or first color pixel) for displaying (or emitting) red color (or red-colored light), the green pixel (G, or second color pixel) for displaying (or emitting) green color (or green-colored light), and the blue pixel (B, or third color pixel) for displaying (or emitting) blue color (or blue-colored light).

The pixels (P) are provided in a repetitive order of the red pixel (R), the green pixel (G), and the blue pixel (B) along every horizontal line of a first direction (X). The pixels (P) for displaying the same color are arranged along a second direction (Y). For example, the display portion (DP) according to one embodiment of the present disclosure can include a plurality of horizontal lines along which first to third color pixels (R, G, B) are arranged in a repetitive order. The first color pixel (R) is connected with the data line of the (3j−2)th column line ("j" is a natural number) among the column line groups in each of the plurality of horizontal lines, and more particularly, the data line in each of the (6j−5)th column line and the (6j−2)th column line. The second color pixel (G) is connected with the data line of the (3j−1)th column line among the column line groups in each of the plurality of horizontal lines, and more particularly, the data line in each of the (6j−4)th column line and the (6j−1)th column line. The third color pixel (B) is connected with the data line of the (3j)th column line among the column line groups in each of the plurality of horizontal lines, and more particularly, the data line in each of the (6j−3)th column line and the (6j)th column line. In this case, among the data lines, the (3j−2)th data lines are connected with the red pixels (R) arranged along the second direction (Y) in common, the (3j−1)th data lines are connected with the green pixels (G) arranged along the second direction (Y) in common, and the (3j)th data lines are connected with the blue pixels (B) arranged along the second direction (Y) in common.

The timing controller 200 aligns the input video data (Idata) to the pixel data (Pdata) of the first time-division period and the pixel data (Pdata) of the second time-division period on the basis of pixel arrangement of the pixels (P) and the first time-division period and the second time-division period every horizontal period.

The timing controller 200 can align the input video data (Idata) for 1 horizontal line, which is to be supplied to the pixels (P) arranged in the (4j−3)th horizontal line (HL4*j*−3) and the (4j−1)th horizontal line (HL4*j*−1) (or odd-numbered horizontal line (HLo)) among the horizontal lines, to the pixel data (Pdata) of the first time-division period to be supplied to the pixels (P) connected with the odd-numbered data line (DLo), and the pixel data (Pdata) of the second time-division period to be supplied to the pixels (P) connected with the even-numbered data line (DLe). In this case, the pixel data (Pdata) of the first time-division period can be aligned in the order of red (R), green (G), and blue (B), and the pixel data (Pdata) of the second time-division period can be aligned in the order of green (G), red (R), and blue (B).

The timing controller 200 can align the input video data (Idata) for 1 horizontal line, which is to be supplied to the pixels (P) arranged in the (4j−2)th horizontal line (HL4*j*−2) and the (4j)th horizontal line (HL4*j*) (or even-numbered horizontal line (HLe)) among the horizontal lines, to the pixel data (Pdata) of the first time-division period to be supplied to the pixels (P) connected with the even-numbered data line (DLe), and the pixel data (Pdata) of the second time-division period to be supplied to the pixels (P) connected with the odd-numbered data line (DLo). In this case, the pixel data (Pdata) of the first time-division period can be aligned in the order of green (G), red (R), and blue (B), and the pixel data (Pdata) of the second time-division period can be aligned in the order of red (R), green (G), and blue (B).

Eventually, the timing controller 200 can align the pixel data (Pdata) of the first time-division period of the (i)th horizontal period ("i" is a natural number) to the data indicating the same color as that of the pixel data (Pdata) of the second time-division period of the (i−1)th horizontal period on the basis of pixel arrangement of the pixels (P) and the first time-division period and the second time-division period every horizontal period.

The column driving circuit 400 converts the pixel data (Pdata) supplied every horizontal period from the timing controller 200 into the analog type data signal, and outputs the analog type data signal through the output channels. In this case, the column driving circuit 400 outputs the first data signal through the output channels in the first time-division period of each horizontal period, and the column driving circuit 400 outputs the second data signal to be supplied to the pixels for displaying the color which is different from that of the first data signal through the output channels in the second time-division period of each horizontal period.

In the first time-division period of the odd-numbered horizontal period, the column driving circuit 400 can output the red data signal through the (3j−2)th output channel (CH3*j*−2), the blue data signal through the (3j−1)th output channel (CH3*j*−1), and the green data signal through the (3j)th output channel (CH3*j*). In the second time-division period of the odd-numbered horizontal period, the column driving circuit 400 can output the green data signal through the (3j−2)th output channel (CH3*j*−2), the red data signal through the (3j−1)th output channel (CH3*j*−1), and the blue data signal through the (3j)th output channel (CH3*j*). For the first time-division period of the even-numbered horizontal period, the column driving circuit 400 can output the green data signal through the (3j−2)th output channel (CH3*j*−2), the red data signal through the (3j−1)th output channel (CH3*j*−1), and the blue data signal through the (3j)th output channel (CH3*j*). For the second time-division period of the even-numbered horizontal period, the column driving circuit 400 can output the red data signal through the (3j−2)th output channel (CH3*j*−2), the blue data signal through the (3j−1)th output channel (CH3*j*−1), and the green data signal through the (3j)th output channel (CH3*j*).

Eventually, the column driving circuit 400 can continuously output the data signal indicating the same color for the second time-division period of the odd-numbered horizontal period and the first time-division period of the even-numbered horizontal period. On the contrary, the column driving circuit 400 can continuously output the data signal indicating the same color in the first time-division period of the odd-numbered horizontal period and the second time-division period of the even-numbered horizontal period. In other words, the column driving circuit 400 can continuously output the data signal indicating the same color to be supplied to the pixels (P) configured to display the same color and to be disposed in the different horizontal lines during 1 horizontal period including the second time-division period of the odd-numbered horizontal period and the first time-division period of the even-numbered horizontal period.

The first data signal to be provided from the output channels of the column driving circuit 400 in the first time-division period of the odd-numbered horizontal period is supplied to the odd-numbered data line (DLo) in accordance with the data distribution of the data distribution circuit 500, and the second data signal to be provided from the output channels of the column driving circuit 400 in the second time-division period of the odd-numbered horizontal period is supplied to the even-numbered data line (DLe) in accordance with the data distribution of the data distribution circuit 500. Meanwhile, the first data signal to be provided from the output channels of the column driving circuit 400 in the first time-division period of the even-numbered horizontal period is supplied to the even-numbered data line (DLe) in accordance with the data distribution of the data distribution circuit 500, and the second data signal to be provided from the output channels of the column driving circuit 400 in the second time-division period of the even-numbered horizontal period is supplied to the odd-numbered data line (DLo) in accordance with the data distribution of the data distribution circuit 500. Thus, the second data signal of the (i)th horizontal period and the first data signal of the (i+1)th horizontal period can be sequentially supplied to the pixels (P) configured to be arranged in the adjacent horizontal lines and to display the same color. In this case, the data distribution circuit 500 can continuously supply the second data signal of the (i)th horizontal period and the first data signal of the (i+1)th horizontal period to any one among the data lines included in the two column line groups.

Figure 4:
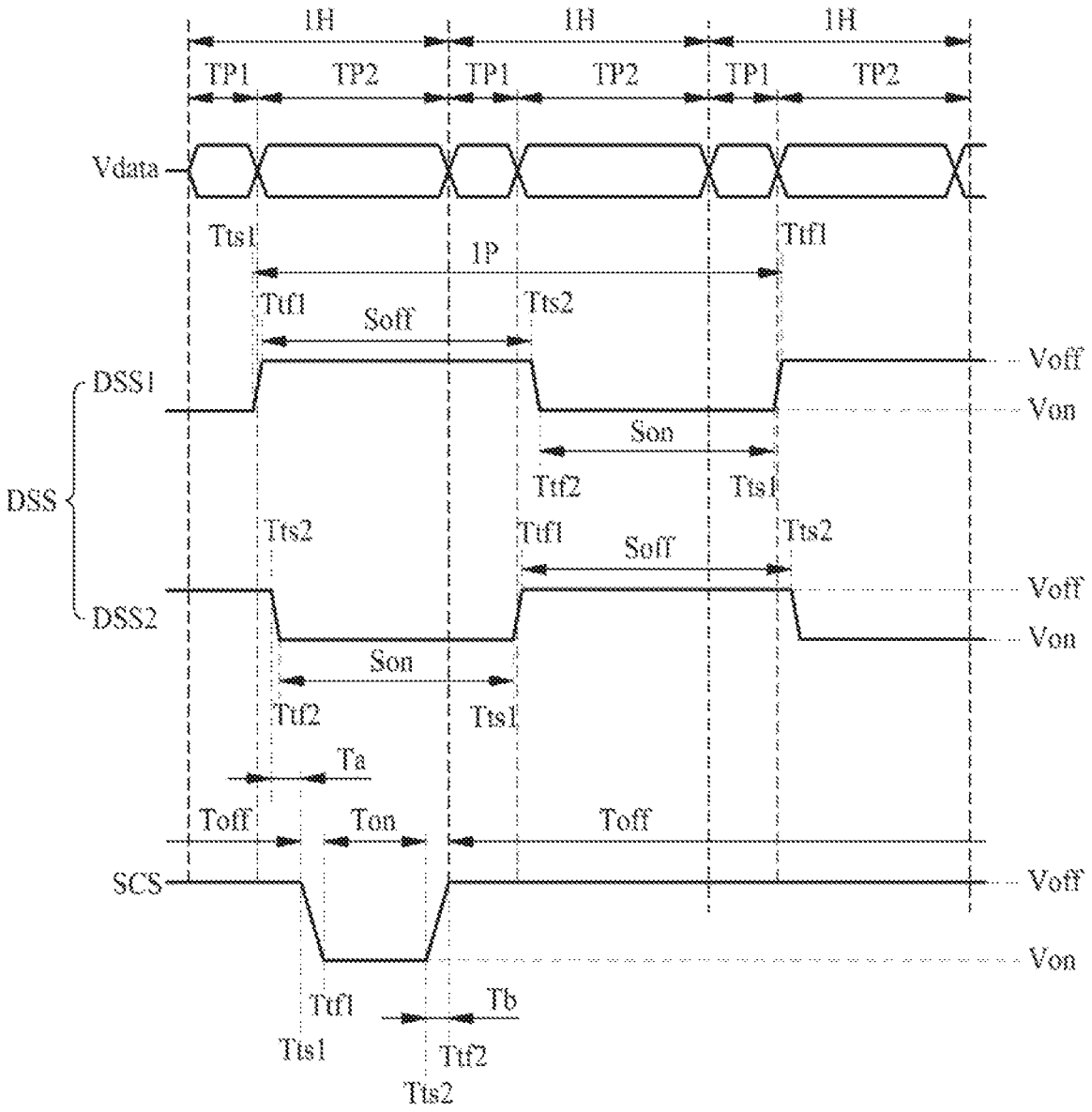
FIG. 4 is an example of a waveform diagram illustrating a data signal, a data selection signal, and a scan control signal in accordance with the pixel structure shown in FIG. 3.

FIG. 4 is a waveform diagram illustrating the data signal, the data selection signal, and the scan control signal in accordance with the pixel structure shown in FIG. 3.

Referring to FIGS. 1 to 4, the pixels (P) according to the present disclosure can be driven by the first time-division period (TP1, or first sub horizontal period) and the second time-division period (TI2, or second sub horizontal period) every 1 horizontal period (1H).

The first time-division period (TP1) can be defined as the first portion of each horizontal period (1H), and the second time-division period (TP2) can be defined as the second portion of each horizontal period (1H).

The first time-division period (TP1) can be set based on a charging time of the data signal (Vdata) charged in the data line. The first time-division period (TP1) according to one embodiment of the present disclosure can be set to be less than the half of 1 horizontal period (1H).

The second time-division period (TP2) can be set based on an operation of the pixel (P). The second time-division period (TP2) according to one embodiment of the present disclosure can be set to be more than the first time-division period (TP1) in the 1 horizontal period (1H). For example, the second time-division period (TP2) can be set as the remaining time period except the first time-division period (TP1) in the 1 horizontal period (1H).

In the second time-division period (TP2), the data signal (Vdata) which is output from the column driving circuit 400 is supplied to the pixel circuit (PC) of the corresponding pixel (P) through the corresponding data line for the sampling period of the pixel (P), whereby the second time-division period (TP2) can be set to be more than the half of 1 horizontal period (1H) in consideration of the sampling period and the initialization period of the pixel (P). On the other hand, in the first time-division period (TP1), the data signal (Vdata) which is output from the column driving circuit 400 is not supplied to the pixel circuit (PC) of the pixel (P), but is charged (or pre-charged) only in the data line, whereby the first time-division period (TP1) can be set to be less than the half of 1 horizontal period (1H) while being corresponding to a charging time (or rising time) of the data signal (Vdata) charged in the data line (or data line capacitance).

The data selection signal (DSS) can include a switch-on period (Son) and a switch-off period (Soff). One period (1P) of the data selection signal (DSS) comprising the switch-on period (Son) and the switch-off period (Soff) can be set to be more than 1 horizontal period (1H). For example, one period (1P) of the data selection signal (DSS) can be identical to 2 horizontal periods. Thus, in the display apparatus according to the present disclosure, one period (1P) of the data selection signal (DSS) is set to be longer than 1 horizontal period (1H) or to be identical to 2 horizontal periods so that a transition of the data selection signal (DSS) is reduced, to thereby reduce power consumption.

The data selection signal (DSS) according to one embodiment of the present disclosure can include a first data selection signal (DSS1), and a second data selection signal (DSS2) which is different from the first data selection signal (DSS1).

Each of the first data selection signal (DSS1) and the second data selection signal (DSS2) can include the switch-on period (Son) for maintaining a switch-on voltage level (Von), and the switch-off period (Soff) for maintaining a switch-off voltage level (Voff). Each of the switch-on period (Son) and the switch-off period (Soff) in each of the first data selection signal (DSS1) and the second data selection signal (DSS2) can include a voltage transition period between the switch-on voltage level (Von) and the switch-off voltage level (Voff).

For the voltage separation and the precise distribution between the first data signal (Vdata) of the first time-division period (TP1) and the second data signal (Vdata) of the second time-division period (TP2) in 1 horizontal period (1H), the voltage transition period between the switch-on voltage level (Von) and the switch-off voltage level (Voff) in the first data selection signal (DSS1) is not overlapped with the voltage transition period between the switch-on voltage level (Von) and the switch-off voltage level (Voff) in the second data selection signal (DSS2).

The switch-on period (Son) of the first data selection signal (DSS1) is not overlapped with the switch-on period (Son) of the second data selection signal (DSS2). For example, the switch-on period (Son) of the first data selection signal (DSS1) can be overlapped with the switch-off period (Soff) of the second data selection signal (DSS2). And, the switch-off period (Soff) of the first data selection signal (DSS1) can be overlapped with the switch-on period (Son) of the second data selection signal (DSS2). Also, the switch-off period (Soff) of the first data selection signal (DSS1) can be partially overlapped with the switch-off period (Soff) of the second data selection signal (DSS2).

The switch-on period (Son) in each of the first data selection signal (DSS1) and the second data selection signal (DSS2) can be set to be longer than the second time-division period (TP2) of 1 horizontal period (1H) and to be shorter than 1 horizontal period (1H) on the basis of the sampling period and the initialization period of the pixels (P), but not necessarily. For example, the switch-on period (Son) in each of the first data selection signal (DSS1) and the second data selection signal (DSS2) can be set to be identical to 1 horizontal period (1H).

The switch-off period (Soff) in each of the first data selection signal (DSS1) and the second data selection signal (DSS2) can be set to be the remaining periods except the switch-on period (Son) in the 2 horizontal periods.

The switch-on period (Son) in each of the first data selection signal (DSS1) and the second data selection signal (DSS2) can be overlapped with the second time-division period (TP2) of the first 1 horizontal period in the continuously-provided 2 horizontal periods and the first time-division period (TP1) of the second 1 horizontal period in the sequentially-provided 2 horizontal periods. For example, the switch-on period (Son) in each of the first data selection signal (DSS1) and the second data selection signal (DSS2) can be overlapped with the second time-division period (TP2) of the (i)th horizontal period and the first time-division period (TP1) of the (i+1)th horizontal period.

Each of the first data selection signal (DSS1) and the second data selection signal (DSS2) according to one embodiment of the present disclosure can include a first transition start point (Tts1) at which the transition from the switch-on voltage level (Von) to the switch-off voltage level (Voff) is started, a first transition completion point (Ttf1) at which the transition from the switch-on voltage level (Von) to the switch-off voltage level (Voff) is completed, a second transition start point (Tts2) at which the transition from the switch-off voltage level (Voff) to the switch-on voltage level (Von) is started, and a second transition completion point (Ttf2) at which the transition from the switch-off voltage level (Voff) to the switch-on voltage level (Von) is completed.

For the pull charge of the data signal (Vdata) in the first time-division period (TP1) of each horizontal period (1H), the first transition start point (Tts1) in each of the first data selection signal (DSS1) and the second data selection signal (DSS2) can be set to be the time point just before the period between the first time-division period (TP1) and the second time-division period (TP2) in each horizontal period (1H).

The first transition completion point (Ttf1) in each of the first data selection signal (DSS1) and the second data selection signal (DSS2) can be set based on the turning-on time in accordance with the driving properties of switch included in the data distribution circuit 500. For example, the first transition completion point (Ttf1) in each of the first data selection signal (DSS1) and the second data selection signal (DSS2) can be set to be the transition period between the first data signal (Vdata) and the second data signal (Vdata) which are sequentially output from the output channels of the column driving circuit 400.

The second transition start point (Tts2) in each of the first data selection signal (DSS1) and the second data selection signal (DSS2) can be set to be the time point after the first transition completion point (Ttf1) while being overlapped with the second time-division period (TP2) of each horizontal period (1H). In this case, it is possible to prevent the switch-on period (Son) of the first data selection signal (DSS1) and the switch-on period (Son) of the second data selection signal (DSS2) from being overlapped with each other, and to secure the sufficient charging time of the data signal (Vdata) in the second time-division period (TP2) of each horizontal period (1H). For example, the second transition start point (Tts2) of the first data selection signal (DSS1) has a predetermined time difference from the first transition completion point (Ttf1) of the second data selection signal (DSS2), whereby the second transition start point (Tts2) of the first data selection signal (DSS1) can be overlapped with the switch-off period (Soff) just after the first transition completion point (Ttf1) of the second data selection signal (DSS2). And, the second transition start point (Tts2) of the second data selection signal (DSS2) has a predetermined time difference from the first transition completion point (Ttf1) of the first data selection signal (DSS1), whereby the second transition start point (Tts2) of the second data selection signal (DSS2) can be overlapped with the switch-off period (Soff) just after the first transition completion point (Ttf1) of the first data selection signal (DSS1).

The second transition completion point (Ttf2) in each of the first data selection signal (DSS1) and the second data selection signal (DSS2) can be set based on the turning-off time in accordance with the driving properties of switch included in the data distribution circuit 500. For example, the second transition completion point (Ttf2) in each of the first data selection signal (DSS1) and the second data selection signal (DSS2) can be set to be the time point after the transition completion of the second data signal (Vdata) which is output from the output channels of the column driving circuit 400.

The scan control signal (SCS) for supplying the data signal (Vdata), which is supplied to or charged in the data lines, to the pixel circuit (PC) of the corresponding pixels (P) can be supplied to the scan control line (SCL) every second time-division period (TP2) of each horizontal period (1H).

The scan control signal (SCS) can include a transistor-on period (Ton) for maintaining the transistor-on voltage level (Von), and a transistor-off period (Toff) for maintaining the transistor-off voltage level (Voff). Each of the transistor-on period (Ton) and the transistor-off period (Toff) in the scan control signal (SCS) can include a voltage transition period between the transistor-on voltage level (Von) and the transistor-off voltage level (Voff).

In order to supply the data signal (Vdata) charged in the data line in the first time-division period (TP1) of 1 horizontal period (1H) and the data signal (Vdata) supplied to the data line for the second time-division period (TP2) of 1 horizontal period (1H) to the pixel circuit (PC) of the corresponding pixels (P) at the same time, the transistor-on period (Ton) of the scan control signal (SCS) can be overlapped with the second time-division period (TP2) while being not overlapped with the first time-division period (TP1) of each horizontal period (1H).

The transistor-on period (Ton) of the scan control signal (SCS) is shorter than the switch-on period (Son) in each of the first data selection signal (DSS1) and the second data selection signal (DSS2). And, the transistor-on period (Ton) of the scan control signal (SCS) can be overlapped with the switch-off period (Soff) of the first data selection signal (DSS1) and the switch-on period (Son) of the second data selection signal (DSS2).

The scan control signal (SCS) according to one embodiment of the present disclosure can include a first transition start point (Tts1) at which the transition from the transistor-off voltage level (Voff) to the transistor-on voltage level (Von) is started, a first transition completion point (Ttf1) at which the transition from the transistor-off voltage level (Voff) to the transistor-on voltage level (Von) is completed, a second transition start point (Tts2) at which the transition from the transistor-on voltage level (Von) to the transistor-off voltage level (Voff) is started, and a second transition completion point (Ttf2) at which the transition from the transistor-on voltage level (Von) to the transistor-off voltage level (Voff) is completed.

The first transition start point (Tts1) of the scan control signal (SCS) can have a predetermined time difference (Ta) from the second transition start point (Tts2) of the first data selection signal (DSS1) or the second transition start point (Tts2) of the second data selection signal (DSS2). In more detail, the first transition start point (Tts1) of the scan control signal (SCS) can be delayed by a preset time period from the second transition completion point (Ttf2) of the overlapped data selection signal (DSS1, DSS2). In this case, the time period between the first transition start point (Tts1) of the scan control signal (SCS) and the second transition completion point (Ttf2) of the data selection signal (DSS1, DSS2) can correspond to the initialization period of the pixels (P), wherein a data pre-charging process for pre-charging the data signal in the data line is carried out for this initialization period so that it is possible to reduce a pixel charging time period for charging the pixel circuit (PC) of the pixels (P) with the data signal through the data line in the transistor-on period (Ton) of the scan control signal (SCS) by the use of data pre-charging process.

The first transition completion point (Ttf1) of the scan control signal (SCS) can be set based on the turning-on time in accordance with the driving properties of the first transistor (T1) of the pixel circuit (PC).

The second transition start point (Ttf2) of the scan control signal (SCS) can be set to be the time point just before an end point of 1 horizontal period (1H) on the basis of sampling period of the pixels (P). For example, the second transition start point (Tts2) of the scan control signal (SCS) can be set to be the time period just before the end point of 1 horizontal period (1H) by a predetermined time period (Tb) based on the turning-off period in accordance with the driving properties of the first transistor (T1).

The second transition completion point (Ttf2) of the scan control signal (SCS) can be set to be the end point of 1 horizontal period (1H).

Figure 5:
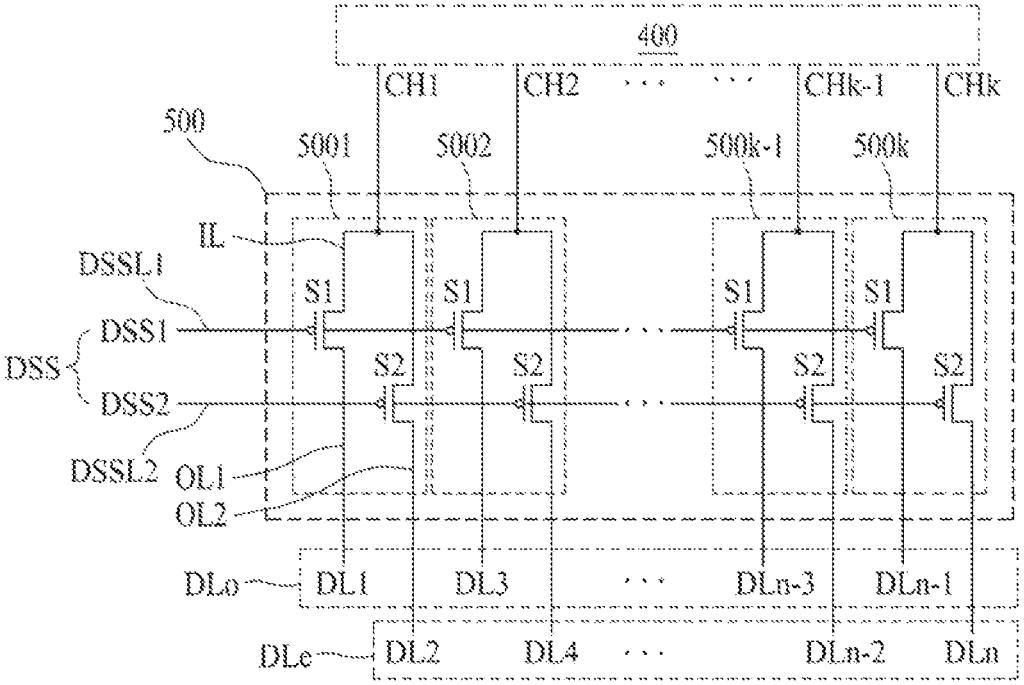
FIG. 5 illustrates an example of a data distribution circuit shown in FIG. 1.

FIG. 5 illustrates the data distribution circuit shown in FIG. 1.

Referring to FIG. 5, the data distribution circuit 500 according to one embodiment of the present disclosure can include a plurality of demultiplex circuits 5001 to 500*k* configured to sequentially supply the first data signal and the second data signal, which are sequentially provided from the output channels (CH1 to CHk) of the column driving circuit 400 every horizontal period, to the two column line groups.

Each of the plurality of demultiplex circuits 5001 to 500*k* sequentially supplies the first data signal and the second data signal, which are sequentially provided from the output channel (CH1 to CHk) of the corresponding column driving circuit 400, to the two data lines in accordance with the data selection signal (DSS).

Each of the plurality of demultiplex circuits 5001 to 500*k* according to one embodiment of the present disclosure can include an input line (IL), a first output line (OL1), a second output line (OL2), a first switch (S1), and a second switch (S2). For example, the plurality of demultiplex circuits 5001 to 500*k* can be 1×2 demultiplex circuits.

The input line (IL) is electrically connected with the corresponding output channel among the output channels (CH1 to CHk) of the column driving circuit 400. That is, the plurality of input lines (IL) included in the data distribution circuit 500 are connected with the output channels (CH1 to CHk) of the column driving circuit 400 in one-to-one correspondence.

The first output line (OL1) is electrically connected with the data line (DLo) of the first column line group in the two column line groups. For example, the first output line (OL1) can be electrically connected with the odd-numbered data line (DLo).

The second output line (OL2) is electrically connected with the data line (DLe) of the second column line group in the two column line groups. For example, the second output line (OL2) can be electrically connected with the even-numbered data line (DLe).

The output lines (OL1, OL2) included in the data distribution circuit 500 can be connected with the data lines (DL1 to DLn) in one-to-one correspondence.

According as the first switch (S1) is turned-on by the first data selection signal (DSS1) of the data selection signal (DSS), the first data signal provided through the input line (IL) is output to the first output line (OL1). The first switch (S1) according to one embodiment of the present disclosure can include a gate electrode connected with the first data selection signal (DSSL1), a first source/drain electrode connected with the input line (IL), and a second source/drain electrode connected with the first output line (OL1). For example, the first switch (S1) can be a P-type (or N-type) thin film transistor.

According as the second switch (S2) is turned-on by the second data selection signal (DSS2) of the data selection signal (DSS), the second data signal provided through the input line (IL) is output to the second output line (OL2). The second switch (S2) according to one embodiment of the present disclosure can include a gate electrode connected with the second data selection signal (DSSL2), a first source/drain electrode connected with the input line (IL), and a second source/drain electrode connected with the second output line (OL2). For example, the second switch (S2) can be a P-type (or N-type) thin film transistor.

Figure 6:
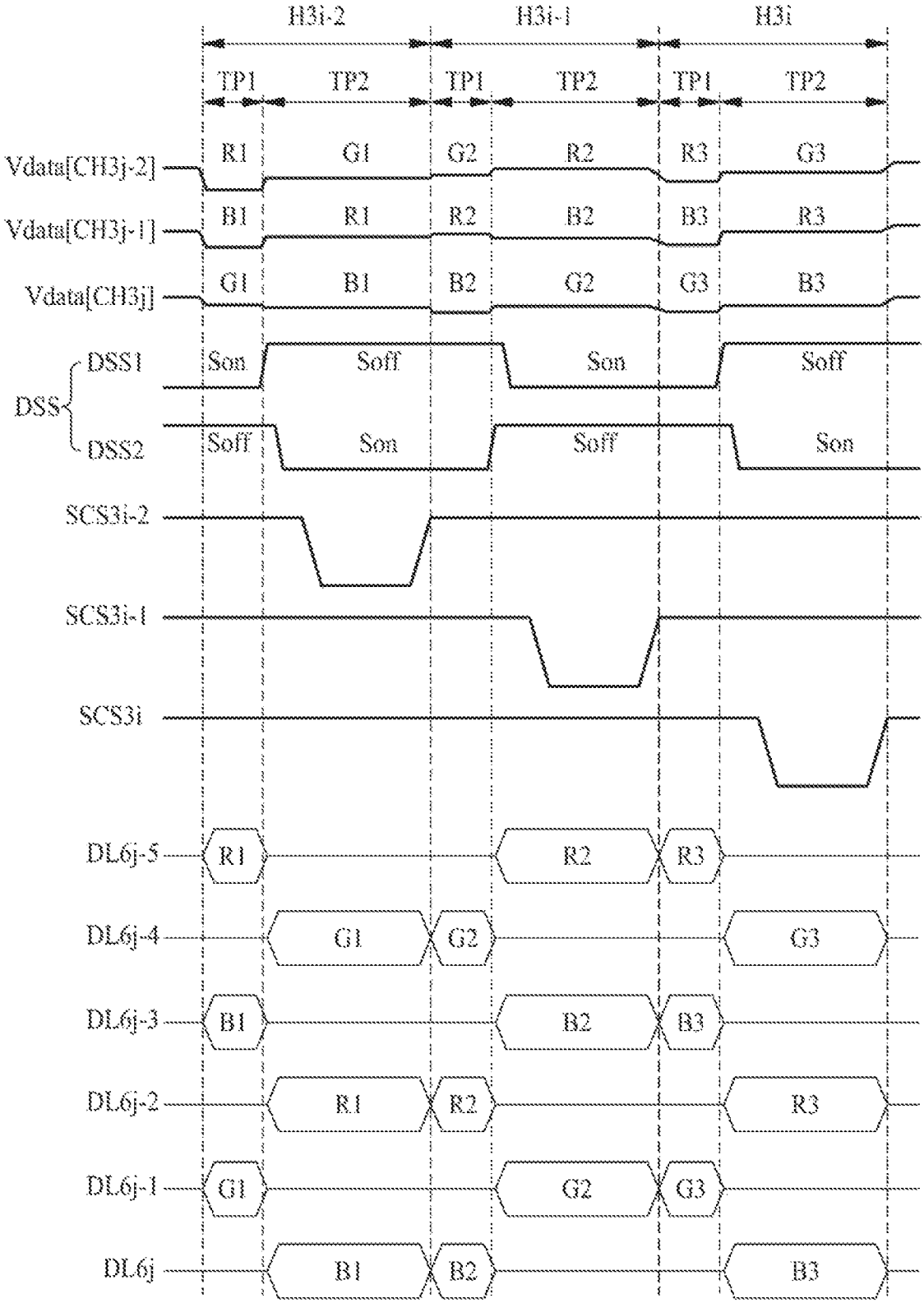
FIG. 6 illustrates an example of a method for supplying a data signal in accordance with the pixel arrangement structure shown in FIG. 3.

FIG. 6 illustrates a method for supplying the data signal in accordance with the pixel arrangement structure shown in FIG. 3, which shows the scan control signal, the data selection signal, and the data signal which are output from the output channel of the column driving circuit in the (3i−2)th to (3i)th horizontal periods.

Referring to FIGS. 1 to 6, first, in the first time-division period (TP1) of the (3i−2)th horizontal period (H3*i*−2), the column driving circuit 400 outputs a first red data signal (R1) to be supplied to the first color pixels (R) arranged in the (4j−3)th horizontal line (HL4*j*−3) through the (3j−2)th output channel (CH3*j*−2), and the data distribution circuit 500 supplies the first red data signal (R1) to the (6j−5)th data line (DL6*j*−5) through the first switch (S1) which maintains the turning-on state in accordance with the switch-on period (Son) of the first data selection signal (DSS1). Accordingly, the first red data signal (R1) is charged in the line capacitance of the (6j−5)th data line (DL6*j*−5). In the first time-division period (TP1) of the (3i−2)th horizontal period (H3*i*−2), the scan control signal (SCS3*i*−2) supplied to the (3i−2)th scan control line is maintained as the transistor-off period.

Then, in the second time-division period (TP2) of the (3i−2)th horizontal period (H3*i*−2), the column driving circuit 400 outputs a first green data signal (G1) to be supplied to the second color pixels (G) arranged in the (4j−3)th horizontal line (HL4*j*−3) through the (3j−2)th output channel (CH3*j*−2), and the data distribution circuit 500 supplies the first green data signal (G1) to the (6j−4)th data line (DL6*j*−4) through the second switch (S2) which is turned-on in accordance with the switch-on period (Son) of the second data selection signal (DSS2). And, according as the scan control signal (SCS3*i*−2) of the transistor-on period is supplied to the (3i−2)th scan control line, the first red data signal (R1) charged in the (6j−5)th data line (DL6*j*−5) is supplied to the pixel circuit (PC) of the pixel (P) connected with the (6j−5)th data line (DL6*j*−5), and the first green data signal (G1) supplied from the data distribution circuit 500 to the (6j−4)th data line (DL6*j*−4) is supplied to the pixel circuit (PC) of the pixel (P) connected with the (6j−4)th data line (DL6*j*−4), at the same time.

Then, in the first time-division period (TP1) of the (3i−1)th horizontal period (H3*i*−1), the column driving circuit 400 outputs a second green data signal (G2) to be supplied to the second color pixels (G) arranged in the (4j−2)th horizontal line (HL4*j*−2) through the (3j−2)th output channel (CH3*j*−2), and the data distribution circuit 500 supplies the second green data signal (G2) to the (6j−4)th data line (DL6*j*−4) through the second switch (S2) which maintains the turning-on state in accordance with the switch-on period (Son) of the second data selection signal (DSS2). That is, the column driving circuit 400 continuously outputs the first green data signal (G1) and the second green data signal (G2) indicating the same color for the second time-division period (TP2) of the (3i−2)th horizontal period (H3*i*−2) and the first time-division period (TP1) of the (3i−1)th horizontal period (H3*i*−1). Accordingly, the second green data signal (G2) is charged in the line capacitance of the (6j−4)th data line (DL6*j*−4). In the first time-division period (TP1) of the (3i−1)th horizontal period (H3*i*−1), the scan control signal (SCS3*i*−1) supplied to the (3i−1)th scan control line is maintained as the transistor-off period.

Then, in the second time-division period (TP2) of the (3i−1)th horizontal period (H3*i*−1), the column driving circuit 400 outputs a second red data signal (R2) to be supplied to the first color pixels (R) arranged in the (4j−2)th horizontal line (HL4*j*−2) through the (3j−2)th output channel (CH3*j*−2), and the data distribution circuit 500 supplies the second red data signal (R2) to the (6j−5)th data line (DL6*j*−5) through the first switch (S1) which is turned-on in accordance with the switch-on period (Son) of the first data selection signal (DSS1). And, according as the scan control signal (SCS3*i*−1) of the transistor-on period is supplied to the (3i−1)th scan control line, the second green data signal (G2) charged in the (6j−4)th data line (DL6*j*−4) is supplied to the pixel circuit (PC) of the pixel (P) connected with the (6j−4)th data line (DL6*j*−4), and the second red data signal (R2) supplied from the data distribution circuit 500 to the (6j−5)th data line (DL6*j*−5) is supplied to the pixel circuit (PC) of the pixel (P) connected with the (6j−5)th data line (DL6*j*−5), at the same time.

Then, in the first time-division period (TP1) of the (3i)th horizontal period (H3*i*), the column driving circuit 400 outputs a third red data signal (R3) to be supplied to the first color pixels (R) arranged in the (4j−1)th horizontal line (HL4*j*−1) through the (3j−2)th output channel (CH3*j*−2), and the data distribution circuit 500 supplies the third red data signal (R3) to the (6j−5)th data line (DL6*j*−5) through the first switch (S1) which maintains the turning-on state in accordance with the switch-on period (Son) of the first data selection signal (DSS1). That is, the column driving circuit 400 continuously outputs the second red data signal (R2) and the third red data signal (R3) indicating the same color in the second time-division period (TP2) of the (3i−1)th horizontal period (H3*i*−1) and the first time-division period (TP1) of the (3i)th horizontal period (H3*i*). Accordingly, the third red data signal (R3) is charged in the line capacitance of the (6j−5)th data line (DL6*j*−5). In the first time-division period (TP1) of the (3i)th horizontal period (H3*i*), the scan control signal (SCS3*i*) supplied to the (3i)th scan control line is maintained as the transistor-off period.

Then, in the second time-division period (TP2) of the (3i)th horizontal period (H3*i*), the column driving circuit 400 outputs a third green data signal (G3) to be supplied to the second color pixels (G) arranged in the (4j−1)th horizontal line (HL4*j*−1) through the (3j−2)th output channel (CH3*j*−2), and the data distribution circuit 500 supplies the third green data signal (G3) to the (6j−4)th data line (DL6*j*−4) through the second switch (S2) which is turned-on in accordance with the switch-on period (Son) of the second data selection signal (DSS2). And, according as the scan control signal (SCS3*i*) of the transistor-on period is supplied to the (3i)th scan control line, the third red data signal (R3) charged in the (6j−5)th data line (DL6*j*−5) is supplied to the pixel circuit (PC) of the pixel (P) connected with the (6j−5)th data line (DL6*j*−5), and the third green data signal (G3) supplied from the data distribution circuit 500 to the (6j−4)th data line (DL6*j*−4) is supplied to the pixel circuit (PC) of the pixel (P) connected with the (6j−4)th data line (DL6*j*−4), at the same time.

In the same manner, in the (3i−2)th horizontal period to the (3i)th horizontal period (H3*i*−2 to H3*i*), the column driving circuit 400 sequentially outputs a first blue data signal (B1), the first red data signal (R1), the second red data signal (R2), a second blue data signal (B2), a third blue data signal (B3), and the third red data signal (R3) through the (3j−1)th output channel (CH3*j*−1), and the data distribution circuit 500 distributes the data in accordance with the first and second data selection signals (DSS1, DSS2), and supplies the corresponding data signal to the pixel circuit (PC) of the pixel (P) connected with each of the (6j−3)th data line (DL6*j*−3) and the (6j−2)th data line (DL6*j*−2).

Further, in the (3i−2)th horizontal period to the (3i)th horizontal period (H3*i*−2 to H3*i*), the column driving circuit 400 sequentially outputs the first green data signal (G1), the first blue data signal (B1), the second blue data signal (B2), the second green data signal (G2), the third green data signal (G3), and the third blue data signal (B3) through the (3j)th output channel (CH3*j*), and the data distribution circuit 500 distributes the data in accordance with the first and second data selection signals (DSS1, DSS2), and supplies the corresponding data signal to the pixel circuit (PC) of the pixel (P) connected with each of the (6j−1)th data line (DL6*j*−1) and the (6j)th data line (DL6*j*).

Figure 7:
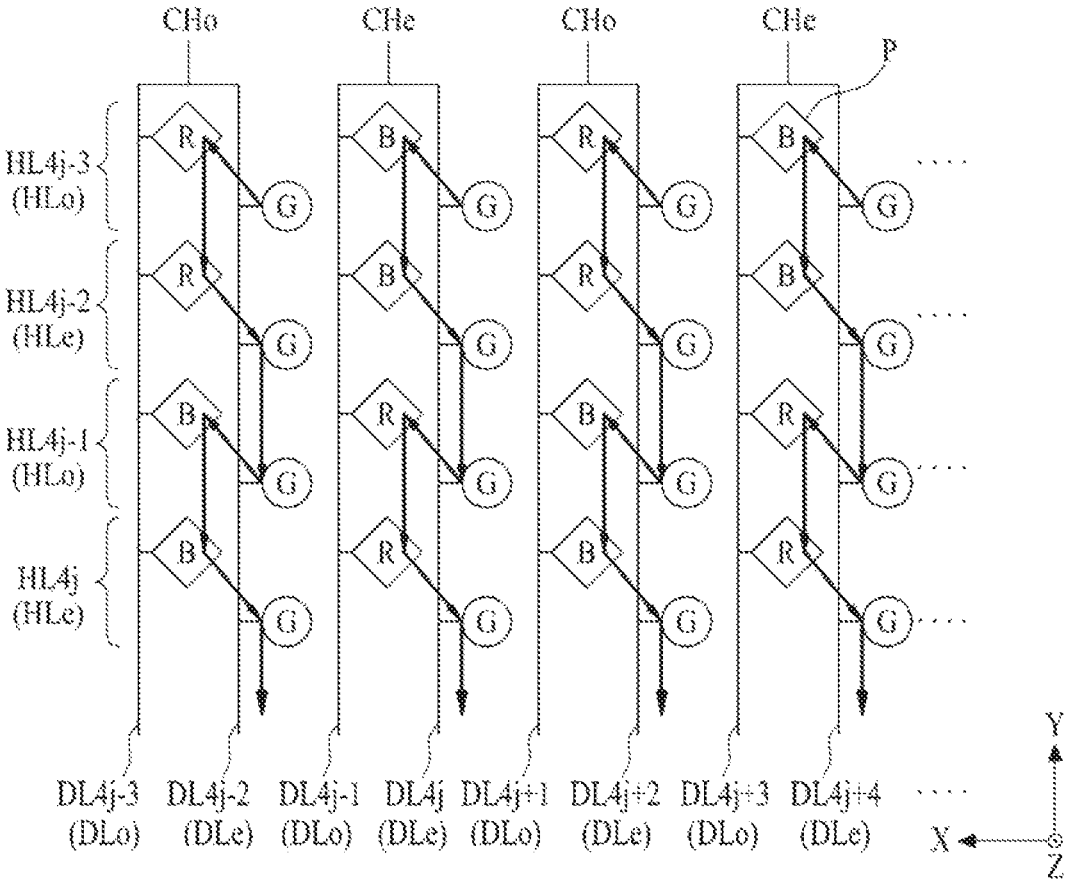
FIG. 7 illustrates an example of an arrangement structure of pixels, an alignment order of pixel data, and a supply order of a data signal according to another embodiment of the present disclosure shown in FIG. 1.

FIG. 7 illustrates an arrangement structure of pixels, an alignment order of pixel data, and a supply order of data signal in accordance with another embodiment of present disclosure shown in FIG. 1.

Referring to FIG. 7 in connection with FIG. 1, a display portion (DP) according to another embodiment of the present disclosure can include a plurality of horizontal lines along which first to third color pixels (R, G, B) are arranged. In this case, the adjacent first to third color pixels (R, G, B) can be arranged in a pentile structure. For example, the first color pixel (R) can be a red pixel, the second color pixel (G) can be a green pixel, and the third color pixel (B) can be a blue pixel, but not limited to these structures.

The first color pixels (R) are connected with the (4j−3)th column line among the column line groups in each of the (4j−3)th horizontal line (HL4*j*−3) and the (4j−2)th horizontal line (HL4*j*−2) among the plurality of horizontal lines, and can be connected with the (4j−1)th column line among the column line groups in each of the (4j−1)th horizontal line (HL4*j*−1) and the (4j)th horizontal line (HL4*j*) among the plurality of horizontal lines.

The second color pixels (G) can be connected with the (4j−2)th column line and the (4j)th column line among the column line groups in each of the plurality of horizontal lines.

The third color pixels (B) are connected with the (4j−1)th column line among the column line groups in each of the (4j−3)th horizontal line (HL4*j*−3) and the (4j−2)th horizontal line (HL4*j*−2), and can be connected with the (4j−3)th column line among the column line groups in each of the (4j−1)th horizontal line (HL4*j*−1) and the (4j)th horizontal line (HL4*j*).

The pixels (P) arranged in each of the (4j−3)th horizontal line (HL4*j*−3) and the (4j−2)th horizontal line (HL4*j*−2) among the plurality of horizontal lines are arranged in a zigzag type along the first direction (X), and the pixels (P) can be provided in a repetitive order of the red pixel (R), the green pixel (G), the blue pixel (B) and the green pixel (G). And, the pixels (P) arranged in each of the (4j−1)th horizontal line (HL4*j*−1) and the (4j)th horizontal line (HL4*j*) among the plurality of horizontal lines are arranged in the zigzag type along the first direction (X), and the pixels (P) can be provided in a repetitive order of the blue pixel (B), the green pixel (G), the red pixel (R) and the green pixel (G).

In the data lines of the column line groups, the (4j−3)th data lines (DL4*j*−3) can be connected with the two of first color pixels (R) and the two of third color pixels (B) alternately arranged along the second direction (Y) in common, the (4j−2)th data lines (DL4*j*−2) can be connected with the second color pixels (G) arranged in the second direction (Y) in common, the (4j−1)th data lines (DL4*j*−1) can be connected with the two of third color pixels (B) and the two of first color pixels (R) alternately arranged along the second direction (Y) in common, and the (4j)th data lines (DL4*j*) can be connected with the second color pixels (G) arranged in the second direction (Y) in common.

The timing controller 200 aligns the input video data (Idata) to the pixel data (Pdata) of the first time-division period and the pixel data (Pdata) of the second time-division period on the basis of pixel arrangement of the pixels (P) and the first time-division period and the second time-division period every horizontal period.

The timing controller 200 can align the input video data (Idata) for 1 horizontal line, which is to be supplied to the pixels (P) arranged in the (4j−3)th horizontal line (HL4*j*−3) and the (4j−1)th horizontal line (HL4*j*−1) (or odd-numbered horizontal line (HLo)) among the horizontal lines, to the pixel data (Pdata) of the first time-division period to be supplied to the pixels (P) connected with the even-numbered data line (DLe), and the pixel data (Pdata) of the second time-division period to be supplied to the pixels (P) connected with the odd-numbered data line (DLo). For example, the timing controller 200 can align green data (G) in the input video data (Idata) for 1 horizontal line, which is to be supplied to the pixels (P) arranged in the (4j−3)th horizontal line (HL4*j*−3), to the pixel data (Pdata) of the first time-division period, and can align red data (R) and blue data (B) to the pixel data (Pdata) of the second time-division period. In this case, in the (4i−3)th horizontal period configured to drive the pixels (P) arranged in the (4j−3)th horizontal line (HL4*j*−3), the pixel data (Pdata) of the first time-division period is aligned with only the green data (G), and the pixel data (Pdata) of the second time-division period can be aligned in the order of the red data (R), the blue data (B), the red data (R) and the blue data (B). And, in the (4i−1)th horizontal period configured to drive the pixels (P) arranged in the (4j−1)th horizontal line (HL4*j*−1), the pixel data (Pdata) of the first time-division period is aligned with only the green data (G), and the pixel data (Pdata) of the second time-division period can be aligned in the order of the blue data (B), the red data (R), the blue data (B) and the red data (R).

The timing controller 200 can align the input video data (Idata) for 1 horizontal line, which is to be supplied to the pixels (P) arranged in the (4j−2)th horizontal line (HL4*j*−2) and the (4j)th horizontal line (HL4*j*) (or even-numbered horizontal line (HLe)) among the horizontal lines, to the pixel data (Pdata) of the first time-division period to be supplied to the pixels (P) connected with the odd-numbered data line (DLo), and the pixel data (Pdata) of the second time-division period to be supplied to the pixels (P) connected with the even-numbered data line (DLe). For example, the timing controller 200 can align red data (R) and blue data (B) in the input video data (Idata) for 1 horizontal line, which is to be supplied to the pixels (P) arranged in the (4j−2)th horizontal line (HL4*j*−2), to the pixel data (Pdata) of the first time-division period, and can align green data (G) to the pixel data (Pdata) of the second time-division period. In this case, in the (4i−2)th horizontal period configured to drive the pixels (P) arranged in the (4j−2)th horizontal line (HL4*j*−2), the pixel data (Pdata) of the first time-division period is aligned in the order of the red data (R), the blue data (B), the red data (R) and the blue data (B), and the pixel data (Pdata) of the second time-division period can be aligned with only the green data (G). And, in the (4i)th horizontal period configured to drive the pixels (P) arranged in the (4j)th horizontal line (HL4*j*), the pixel data (Pdata) of the first time-division period is aligned in the order of the blue data (B), the red data (R), the blue data (B) and the red data (R), and the pixel data (Pdata) of the second time-division period can be aligned with only the green data (G).

Eventually, the timing controller 200 can align the pixel data (Pdata) of the first time-division period of the (i)th horizontal period to the data indicating the same color as that of the pixel data (Pdata) of the second time-division period of the (i−1)th horizontal period on the basis of pixel arrangement of the pixels (P) and the first time-division period and the second time-division period every horizontal period, and can align the pixel data (Pdata) of the first time-division period of the (i+1)th horizontal period to the data indicating the same color as that of the pixel data (Pdata) of the second time-division period of the (i)th horizontal period The column driving circuit 400 converts the pixel data (Pdata) supplied every horizontal period from the timing controller 200 into the analog type data signal, and outputs the analog type data signal through the output channels. In this case, the column driving circuit 400 outputs the first data signal through the output channels in the first time-division period of each horizontal period, and the column driving circuit 400 outputs the second data signal to be supplied to the pixels for displaying the color which is different from that of the first data signal through the output channels in the second time-division period of each horizontal period.

In the (4i−3)th horizontal period, the column driving circuit 400 outputs the green data signal through each output channel (CHo, CHe) in the first time-division period, and outputs the red data signal through the odd-numbered output channel (CHo) and the blue data signal through the even-numbered output channel (CHe) in the second time-division period.

In the (4i−2)th horizontal period, the column driving circuit 400 outputs the red data signal through the odd-numbered output channel (CHo) and the blue data signal through the even-numbered output channel (CHe) in the first time-division period, and outputs the green data signal through each output channel (CHo, CHe) in the second time-division period.

In the (4i−1)th horizontal period, the column driving circuit 400 outputs the green data signal through each output channel (CHo, CHe) in the first time-division period, and outputs the blue data signal through the odd-numbered output channel (CHo) and the red data signal through the even-numbered output channel (CHe) in the second time-division period.

In the (4i)th horizontal period, the column driving circuit 400 outputs the blue data signal through the odd-numbered output channel (CHo) and the red data signal through the even-numbered output channel (CHe) in the first time-division period, and outputs the green data signal through each output channel (CHo, CHe) in the second time-division period.

Eventually, the column driving circuit 400 can continuously output the data signals indicating the same color in the second time-division period of the odd-numbered horizontal period and the first time-division period of the even-numbered horizontal period. On the contrary, the column driving circuit 400 can continuously output the data signals indicating the same color in the first time-division period of the odd-numbered horizontal period and the second time-division period of the even-numbered horizontal period. In other words, the column driving circuit 400 can continuously output the data signals indicating the same color to be supplied to the pixels (P) configured to display the same color and arranged in the different horizontal lines in 1 horizontal period including the second time-division period of the odd-numbered horizontal period and the first time-division period of the even-numbered horizontal period.

The first data signal, which is output from the output channels of the column driving circuit 400 in the first time-division period of the odd-numbered horizontal period, is supplied to the even-numbered data line (DLe) in accordance with the data distribution of the data distribution circuit 500, and the second data signal, which is output from the output channels of the column driving circuit 400 in the second time-division period of the odd-numbered horizontal period, is supplied to the odd-numbered data line (DLo) in accordance with the data distribution of the data distribution circuit 500. Meanwhile, the first data signal, which is output from the output channels of the column driving circuit 400 in the first time-division period of the even-numbered horizontal period, is supplied to the odd-numbered data line (DLo) in accordance with the data distribution of the data distribution circuit 500, and the second data signal, which is output from the output channels of the column driving circuit 400 in the second time-division period of the even-numbered horizontal period, is supplied to the even-numbered data line (DLe) in accordance with the data distribution of the data distribution circuit 500. Accordingly, the second data signal of the (i)th horizontal period and the first data signal of the (i+1)th horizontal period can be sequentially supplied to the pixels (P) configured to display the same color and arranged in the adjacent horizontal lines. In this case, the data distribution circuit 500 can continuously supply the second data signal of the (i)th horizontal period and the first data signal of the (i+1)th horizontal period to any one of the data lines included the two column line groups.

Figure 8:
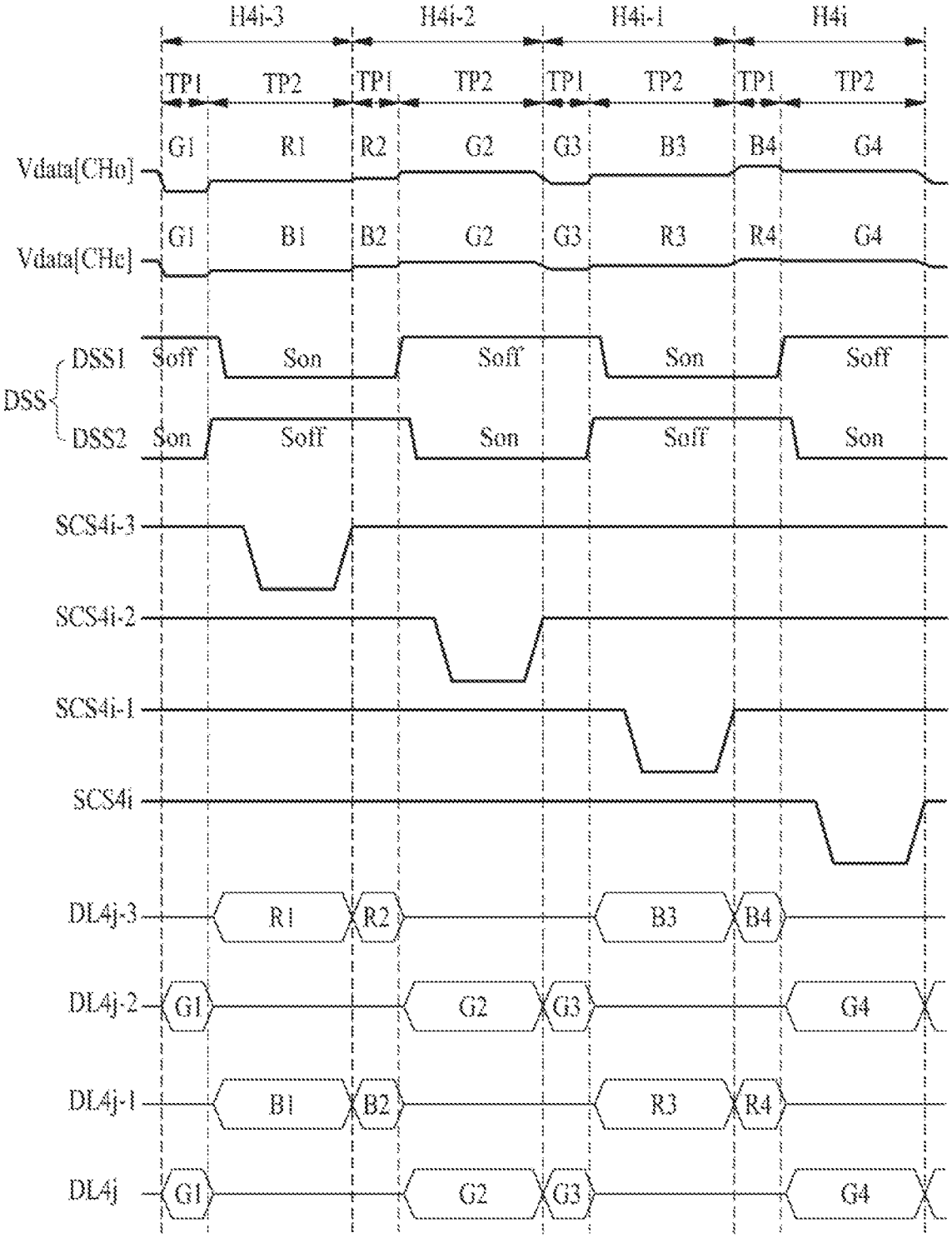
FIG. 8 illustrates an example of a method for supplying a data signal in accordance with the pixel arrangement structure shown in FIG. 7.

FIG. 8 illustrates a method for supplying the data signal in accordance with the pixel arrangement structure shown in FIG. 7, which shows the scan control signal, the data selection signal, and the data signal which are output from the output channels of the column driving circuit in the (4i−3)th to (4i)th horizontal periods.

Referring to FIGS. 1, 5, 7, and 8, first, in the first time-division period (TP1) of the (4i−3)th horizontal period (H4*i*−3), the column driving circuit 400 outputs the first green data signal (G1) to be supplied to the second color pixels (G) arranged in the (4j−3)th horizontal line (HL4*j*−3) through the odd-numbered output channel (CHo), and the data distribution circuit 500 supplies the first green data signal (G1) to the (4j−2)th data line (DL4*j*−2) through the second switch (S2) which maintains the turning-on state in accordance with the switch-on period (Son) of the second data selection signal (DSS2). Accordingly, the first green data signal (G1) is charged in the line capacitance of the (4j−2)th data line (DL4*j*−2). In the first time-division period (TP1) of the (4i−3)th horizontal period (H4*i*−3), the scan control signal (SCS4*i*−3) supplied to the (4i−3)th scan control line is maintained as the transistor-off period.

Then, in the second time-division period (TP2) of the (4i−3)th horizontal period (H4*i*−3), the column driving circuit 400 outputs the first red data signal (R1) to be supplied to the first color pixels (R) arranged in the (4j−3)th horizontal line (HL4*j*−3) through the odd-numbered output channel (CHo), and the data distribution circuit 500 supplies the first red data signal (R1) to the (4j−3)th data line (DL4*j*−3) through the first switch (S1) which is turned-on in accordance with the switch-on period (Son) of the first data selection signal (DSS1). And, according as the scan control signal (SCS4*i*−3) of the transistor-on period is supplied to the (4i−3)th scan control line, the first green data signal (G1) charged in the (4j−2)th data line (DL4*j*−2) is supplied to the pixel circuit (PC) of the pixel (P) connected with the (4j−2)th data line (DL4*j*−2), and the first red data signal (R1) supplied from the data distribution circuit 500 to the (4j−3)th data line (DL4*j*−3) is supplied to the pixel circuit (PC) of the pixel (P) connected with the (4j−3)th data line (DL4*j*−3), at the same time.

Then, in the first time-division period (TP1) of the (4i−2)th horizontal period (H4*i*−2), the column driving circuit 400 outputs the second red data signal (R2) to be supplied to the first color pixels (R) arranged in the (4j−2)th horizontal line (HL4*j*−2) through the odd-numbered output channel (CHo), and the data distribution circuit 500 supplies the second red data signal (R2) to the (4j−3)th data line (DL4*j*−3) through the first switch (S1) which maintains the turning-on state in accordance with the switch-on period (Son) of the first data selection signal (DSS1). That is, the column driving circuit 400 continuously outputs the first red data signal (R1) and the second red data signal (R2) indicating the same color for the second time-division period (TP2) of the (4i−3)th horizontal period (H3*i*−2) and the first time-division period (TP1) of the (4i−2)th horizontal period (H4*i*−2). Accordingly, the second red data signal (R2) is charged in the line capacitance of the (4j−3)th data line (DL4*j*−3). In the first time-division period (TP1) of the (4i−2)th horizontal period (H4*i*−2), the scan control signal (SCS4*i*−2) supplied to the (4i−2)th scan control line is maintained as the transistor-off period.

Then, in the second time-division period (TP2) of the (4i−2)th horizontal period (H4*i*−2), the column driving circuit 400 outputs the second green data signal (G2) to be supplied to the second color pixels (G) arranged in the (4j−2)th horizontal line (HL4*j*−2) through the odd-numbered output channel (CHo), and the data distribution circuit 500 supplies the second green data signal (G2) to the (4j−2)th data line (DL4*j*−2) through the second switch (S2) which is turned-on in accordance with the switch-on period (Son) of the second data selection signal (DSS2). And, according as the scan control signal (SCS4*i*−2) of the transistor-on period is supplied to the (4i−2)th scan control line, the second red data signal (R2) charged in the (4j−3)th data line (DL4*j*−3) is supplied to the pixel circuit (PC) of the pixel (P) connected with the (4j−3)th data line (DL4*j*−3), and the second green data signal (G2) supplied from the data distribution circuit 500 to the (4j−2)th data line (DL4*j*−2) is supplied to the pixel circuit (PC) of the pixel (P) connected with the (4j−2)th data line (DL4*j*−2), at the same time.

Then, in the first time-division period (TP1) of the (4i−1)th horizontal period (H4*i*−1), the column driving circuit 400 outputs the third green data signal (G3) to be supplied to the second color pixels (G) arranged in the (4j−1)th horizontal line (HL4*j*−1) through the odd-numbered output channel (CHo), and the data distribution circuit 500 supplies the third green data signal (G3) to the (4j−2)th data line (DL4*j*−2) through the second switch (S2) which maintains the turning-on state in accordance with the switch-on period (Son) of the second data selection signal (DSS2). That is, the column driving circuit 400 continuously outputs the second green data signal (G2) and the third green data signal (G3) indicating the same color in the second time-division period (TP2) of the (4i−2)th horizontal period (H4*i*−2) and the first time-division period (TP1) of the (4i−1)th horizontal period (H4*i*−1). Accordingly, the third green data signal (G3) is charged in the line capacitance of the (4j−2)th data line (DL4*j*−2). In the first time-division period (TP1) of the (4i−1)th horizontal period (H4*i*−1), the scan control signal (SCS4*i*−1) supplied to the (4i−1)th scan control line is maintained as the transistor-off period.

Then, in the second time-division period (TP2) of the (4i−1)th horizontal period (H4*i*−1), the column driving circuit 400 outputs the third blue data signal (B3) to be supplied to the third color pixels (B) arranged in the (4j−1)th horizontal line (HL4*j*−1) through the odd-numbered output channel (CHo), and the data distribution circuit 500 supplies the third blue data signal (B3) to the (4j−3)th data line (DL4*j*−3) through the first switch (S1) which is turned-on in accordance with the switch-on period (Son) of the first data selection signal (DSS1). And, according as the scan control signal (SCS4*i*−1) of the transistor-on period is supplied to the (4i−1)th scan control line, the third green data signal (G3) charged in the (4j−2)th data line (DL4*j*−2) is supplied to the pixel circuit (PC) of the pixel (P) connected with the (4j−2)th data line (DL4*j*−2), and the third blue data signal (B3) supplied from the data distribution circuit 500 to the (4j−3)th data line (DL4*j*−3) is supplied to the pixel circuit (PC) of the pixel (P) connected with the (4j−3)th data line (DL4*j*−3), at the same time.

Then, in the first time-division period (TP1) of the (4i)th horizontal period (H4*i*), the column driving circuit 400 outputs a fourth blue data signal (B4) to be supplied to the third color pixels (B) arranged in the (4j)th horizontal line (HL4*j*) through the odd-numbered output channel (CHo), and the data distribution circuit 500 supplies the fourth blue data signal (B4) to the (4j−3)th data line (DL4*j*−3) through the first switch (S1) which maintains the turning-on state in accordance with the switch-on period (Son) of the first data selection signal (DSS1). That is, the column driving circuit 400 continuously outputs the third blue data signal (B3) and the fourth blue data signal (B4) indicating the same color in the second time-division period (TP2) of the (4i−1)th horizontal period (H4*i*−1) and the first time-division period (TP1) of the (4i)th horizontal period (H4*i*). Accordingly, the third blue data signal (B3) is charged in the line capacitance of the (4j−3)th data line (DL4*j*−3). In the first time-division period (TP1) of the (4i)th horizontal period (H4*i*), the scan control signal (SCS4*i*) supplied to the (4i)th scan control line is maintained as the transistor-off period.

Then, in the second time-division period (TP2) of the (4i)th horizontal period (H4*i*), the column driving circuit 400 outputs a fourth green data signal (G4) to be supplied to the second color pixels (G) arranged in the (4j)th horizontal line (HL4*j*) through the odd-numbered output channel (CHo), and the data distribution circuit 500 supplies the fourth green data signal (G4) to the (4j−2)th data line (DL4*j*−2) through the second switch (S2) which is turned-on in accordance with the switch-on period (Son) of the second data selection signal (DSS2). And, according as the scan control signal (SCS4*i*) of the transistor-on period is supplied to the (4i)th scan control line, the fourth blue data signal (B4) charged in the (4j−3)th data line (DL4*j*−3) is supplied to the pixel circuit (PC) of the pixel (P) connected with the (4j−3)th data line (DL4*j*−3), and the fourth green data signal (G4) supplied from the data distribution circuit 500 to the (4j−2)th data line (DL4*j*−2) is supplied to the pixel circuit (PC) of the pixel (P) connected with the (4j−2)th data line (DL4*j*−2), at the same time.

In the same manner, in the (4i−3)th horizontal period to the (4i)th horizontal period (H4*i*−3 to H4*i*), the column driving circuit 400 sequentially outputs the first green data signal (G1), the first blue data signal (B1), the second blue data signal (B2), the second green data signal (G2), the third green data signal (G3), the third red data signal (R3), the fourth red data signal (R4), and the fourth green data signal (G4) through the even-numbered output channel (CHe), and the data distribution circuit 500 distributes the data in accordance with the first and second data selection signals (DSS1, DSS2), and supplies the corresponding data signal to the pixel circuit (PC) of the pixel (P) connected with each of the (4j−1)th data line (DL4*j*−1) and the (4j)th data line (DL4*j*).

Figure 9:
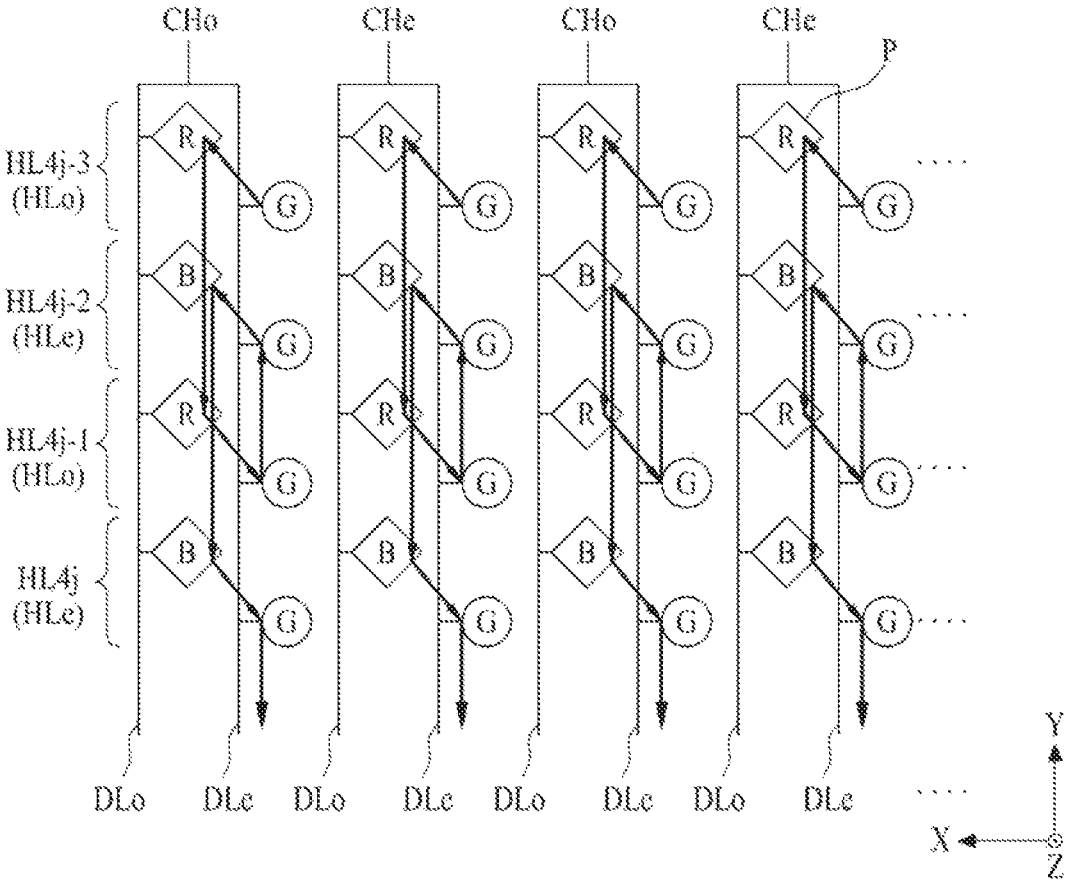
FIG. 9 illustrates an example of an arrangement structure of pixels, an alignment order of pixel data, and a supply order of a data signal according to another embodiment of the present disclosure shown in FIG. 1.

FIG. 9 illustrates an arrangement structure of pixels, an alignment order of pixel data, and a supply order of data signal in accordance with another embodiment of FIG. 1.

Referring to FIG. 9 in connection with FIG. 1, a display portion (DP) according to another embodiment of the present disclosure can include a plurality of horizontal lines along which two color pixel combinations among first to third color pixels (R, G, B) are arranged. In this case, the adjacent first to third color pixels (R, G, B) can be arranged in a pentile structure. For example, the first color pixel (R) can be a red pixel, the second color pixel (G) can be a green pixel, and the third color pixel (B) can be a blue pixel, but not limited to these structures.

Among the plurality of horizontal lines, the odd-numbered horizontal line (HLo, or (4j−3)th horizontal line (HL4*j*−3) or (4j−1)th horizontal line (HL4*j*−1)) can include the first color pixel (R) connected with the odd-numbered column line among the column line groups, and the second color pixel (G) connected with the even-numbered column line among the column line groups. The first color pixel (R) and the second color pixel (G) arranged in the odd-numbered horizontal line (HLo) can be repetitively arranged in a zigzag type along a first direction (X).

Among the plurality of horizontal lines, the even-numbered horizontal line (HLe, or (4j−2)th horizontal line (HL4*j*−2) or (4j)th horizontal line (HL4*j*)) can include the third color pixel (B) connected with the odd-numbered column line among the column line groups, and the second color pixel (G) connected with the even-numbered column line among the column line groups. The third color pixel (B) and the second color pixel (G) arranged in the even-numbered horizontal line (HLe) can be repetitively arranged in a zigzag type along the first direction (X).

In the data lines of the column line groups, the odd-numbered data lines (DLo) can be connected with the first color pixel (R) and the third color pixel (B) alternately arranged along a second direction (Y) in common, and the even-numbered data lines (DLe) can be connected with the second color pixels (G) arranged along the second direction (Y) in common.

The timing controller 200 aligns the input video data (Idata) to the pixel data (Pdata) of the first time-division period and the pixel data (Pdata) of the second time-division period on the basis of pixel arrangement of the pixels (P) and the first time-division period and the second time-division period every horizontal period.

The timing controller 200 can align the input video data (Idata) for 1 horizontal line, which is to be supplied to the pixels (P) arranged in the (4j−3)th horizontal line (HL4*j*−3), to the pixel data (Pdata) of the first time-division period to be supplied to the pixels (P) connected with the even-numbered data line (DLe), and the pixel data (Pdata) of the second time-division period to be supplied to the pixels (P) connected with the odd-numbered data line (DLo). For example, the timing controller 200 can align green data (G) in the input video data (Idata) for 1 horizontal line, which is to be supplied to the pixels (P) arranged in the (4j−3)th horizontal line (HL4*j*−3), to the pixel data (Pdata) of the first time-division period, and can align red data (R) to the pixel data (Pdata) of the second time-division period.

The timing controller 200 can align the input video data (Idata) for 1 horizontal line, which is to be supplied to the pixels (P) arranged in the (4j−2)th horizontal line (HL4*j*−2), to the pixel data (Pdata) of the first time-division period to be supplied to the pixels (P) connected with the even-numbered data line (DLe), and the pixel data (Pdata) of the second time-division period to be supplied to the pixels (P) connected with the odd-numbered data line (DLo). For example, the timing controller 200 can align green data (G) in the input video data (Idata) for 1 horizontal line, which is to be supplied to the pixels (P) arranged in the (4j−2)th horizontal line (HL4*j*−2), to the pixel data (Pdata) of the first time-division period, and can align blue data (B) to the pixel data (Pdata) of the second time-division period.

The timing controller 200 can align the input video data (Idata) for 1 horizontal line, which is to be supplied to the pixels (P) arranged in the (4j−1)th horizontal line (HL4*j*−1) among the horizontal lines, to the pixel data (Pdata) of the first time-division period to be supplied to the pixels (P) connected with the odd-numbered data line (DLo), and the pixel data (Pdata) of the second time-division period to be supplied to the pixels (P) connected with the even-numbered data line (DLe). For example, the timing controller 200 can align red data (R) in the input video data (Idata) for 1 horizontal line, which is to be supplied to the pixels (P) arranged in the (4j−1)th horizontal line (HL4*j*−1), to the pixel data (Pdata) of the first time-division period, and can align green data (G) to the pixel data (Pdata) of the second time-division period.

The timing controller 200 can align the input video data (Idata) for 1 horizontal line, which is to be supplied to the pixels (P) arranged in the (4j)th horizontal line (HL4*j*), to the pixel data (Pdata) of the first time-division period to be supplied to the pixels (P) connected with the odd-numbered data line (DLo), and the pixel data (Pdata) of the second time-division period to be supplied to the pixels (P) connected with the even-numbered data line (DLe). For example, the timing controller 200 can align blue data (B) in the input video data (Idata) for 1 horizontal line, which is to be supplied to the pixels (P) arranged in the (4j)th horizontal line (HL4*j*), to the pixel data (Pdata) of the first time-division period, and can align green data (G) to the pixel data (Pdata) of the second time-division period.

Eventually, the timing controller 200 can align the pixel data (Pdata) of the first time-division period of the (i)th horizontal period to the data indicating the same color as that of the pixel data (Pdata) of the second time-division period of the (i−2)th horizontal period on the basis of pixel arrangement of the pixels (P) and the first time-division period and the second time-division period every horizontal period, and can align the pixel data (Pdata) of the second time-division period of the (i)th horizontal period to the data indicating the same color as that of the pixel data (Pdata) of the second time-division period of the (i−1)th horizontal period.

The column driving circuit 400 converts the pixel data (Pdata) supplied every horizontal period from the timing controller 200 into the analog type data signal, and outputs the analog type data signal through the output channels. In this case, the column driving circuit 400 outputs the first data signal through the output channels in the first time-division period of each horizontal period, and the column driving circuit 400 outputs the second data signal to be supplied to the pixels for displaying the color which is different from that of the first data signal through the output channels in the second time-division period of each horizontal period.

In the (4i−3)th horizontal period, the column driving circuit 400 outputs the green data signal to be supplied to the second color pixels (G) arranged in the (4j−3)th horizontal line (HL4*j*−3) through each output channel (CHo, CHe) in the first time-division period, and outputs the red data signal to be supplied to the first color pixels (R) arranged in the (4j−3)th horizontal line (HL4*j*−3) through each output channel (CHo, CHe) in the second time-division period.

In the (4i−2)th horizontal period, the column driving circuit 400 outputs the red data signal to be supplied to the first color pixels (R) arranged in the (4j−1)th horizontal line (HL4*j*−1) through each output channel (CHo, CHe) in the first time-division period, and outputs the green data signal to be supplied to the second color pixels (G) arranged in the (4j−1)th horizontal line (HL4*j*−1) through each output channel (CHo, CHe) in the second time-division period.

In the (4i−1)th horizontal period, the column driving circuit 400 outputs the green data signal to be supplied to the second color pixels (G) arranged in the (4j−2)th horizontal line (HL4*j*−2) through each output channel (CHo, CHe) in the first time-division period, and outputs the blue data signal to be supplied to the third color pixels (B) arranged in the (4j−2)th horizontal line (HL4*j*−2) through each output channel (CHo, CHe) in the second time-division period.

In the (4i)th horizontal period, the column driving circuit 400 outputs the blue data signal to be supplied to the third color pixels (B) arranged in the (4j)th horizontal line (HL4*j*) through each output channel (CHo, CHe) in the first time-division period, and outputs the green data signal to be supplied to the second color pixels (G) arranged in the (4j)th horizontal line (HL4*j*) through each output channel (CHo, CHe) in the second time-division period.

Eventually, the column driving circuit 400 can continuously output the data signals indicating the same color in the second time-division period of the (4i−3)th horizontal period and the first time-division period of the (4i−2)th horizontal period, and can continuously output the data signals indicating the same color in the second time-division period of the (4i−2)th horizontal period and the first time-division period of the (4i−1)th horizontal period. And, the column driving circuit 400 can continuously output the data signals indicating the same color in the second time-division period of the (4i−1)th horizontal period and the first time-division period of the (4i)th horizontal period, and can continuously output the data signals indicating the same color in the second time-division period of the (4i)th horizontal period and the first time-division period of the (4i−3)th horizontal period. In other words, the column driving circuit 400 can continuously output the data signals indicating the same color to be supplied to the pixels (P) configured to display the same color and arranged in the different horizontal lines in 1 horizontal period including the second time-division period of the odd-numbered horizontal period and the first time-division period of the even-numbered horizontal period.

The first data signal, which is output from the output channels of the column driving circuit 400 in the first time-division period of each of the (4i−3)th horizontal period and the (4i−1)th horizontal period, is supplied to the even-numbered data line (DLe) in accordance with the data distribution of the data distribution circuit 500, and the second data signal, which is output from the output channels of the column driving circuit 400 in the second time-division period of each of the (4i−3)th horizontal period and the (4i−1)th horizontal period, is supplied to the odd-numbered data line (DLo) in accordance with the data distribution of the data distribution circuit 500. Meanwhile, the first data signal, which is output from the output channels of the column driving circuit 400 in the first time-division period of each of the (4i−2)th horizontal period and the (4i)th horizontal period, is supplied to the odd-numbered data line (DLo) in accordance with the data distribution of the data distribution circuit 500, and the second data signal, which is output from the output channels of the column driving circuit 400 in the second time-division period of each of the (4i−2)th horizontal period and the (4i)th horizontal period, is supplied to the even-numbered data line (DLe) in accordance with the data distribution of the data distribution circuit 500.

Accordingly, the second data signal of the (4i−3)th horizontal period and the first data signal of the (4i−2)th horizontal period can be sequentially supplied to the pixels (P) configured to display the same color and arranged in the adjacent odd-numbered horizontal lines (HLo). The second data signal of the (4i−1)th horizontal period and the first data signal of the (4i)th horizontal period can be sequentially supplied to the pixels (P) configured to display the same color and arranged in the adjacent even-numbered horizontal lines (HLe). The second data signal of the (4i−2)th horizontal period and the first data signal of the (4i−1)th horizontal period can be sequentially supplied to the pixels (P) configured to display the same color, arranged in the adjacent horizontal lines, and connected with the even-numbered data line (DLe). The second data signal of the (4i)th horizontal period and the first data signal of the (4i−3)th horizontal period can be sequentially supplied to the pixels (P) configured to display the same color, arranged in the adjacent horizontal lines, and connected with the even-numbered data line (DLe).

Figure 10:
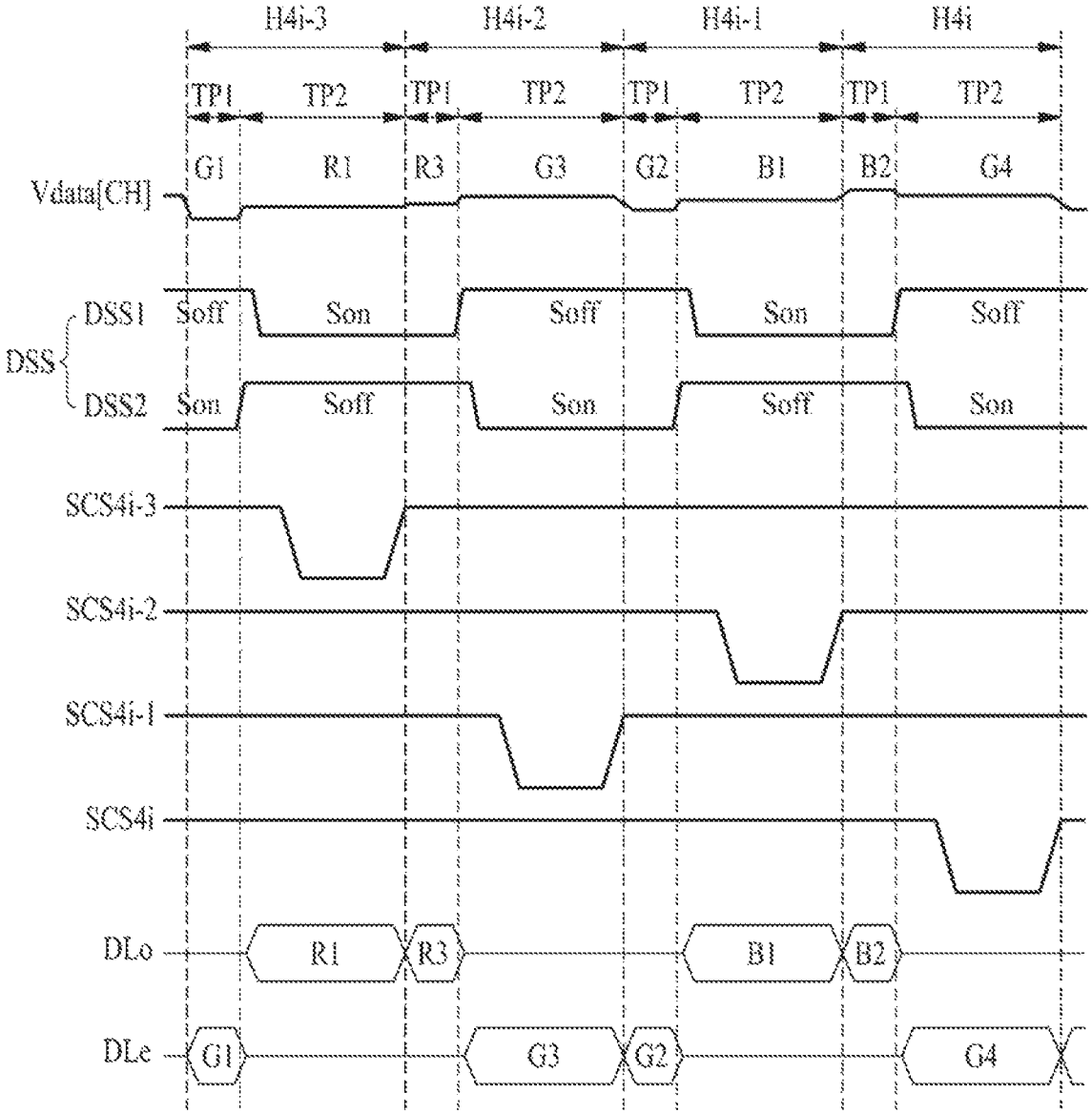
FIG. 10 illustrates an example of a method for supplying a data signal in accordance with the pixel arrangement structure shown in FIG. 9.

FIG. 10 illustrates a method for supplying the data signal in accordance with the pixel arrangement structure shown in FIG. 9, which shows the scan control signal, the data selection signal, and the data signal which are output from the output channel of the column driving circuit in the (4i−3)th to (4i)th horizontal periods.

Referring to FIGS. 1, 5, 9 and 10, first, in the first time-division period (TP1) of the (4i−3)th horizontal period (H4*i*−3), the column driving circuit 400 outputs the first green data signal (G1) to be supplied to the second color pixels (G) arranged in the (4j−3)th horizontal line (HL4*j*−3) through each output channel (CH), and the data distribution circuit 500 supplies the first green data signal (G1) to the even-numbered data line (DLe) through the second switch (S2) which maintains the turning-on state in accordance with the switch-on period (Son) of the second data selection signal (DSS2). Accordingly, the first green data signal (G1) is charged in the line capacitance of the even-numbered data line (DLe). In the first time-division period (TP1) of the (4i−3)th horizontal period (H4*i*−3), the scan control signal (SCS4*i*−3) supplied to the (4i−3)th scan control line is maintained as the transistor-off period.

Then, in the second time-division period (TP2) of the (4i−3)th horizontal period (H4*i*−3), the column driving circuit 400 outputs the first red data signal (R1) to be supplied to the first color pixels (R) arranged in the (4j−3)th horizontal line (HL4*j*−3) through each output channel (CH), and the data distribution circuit 500 supplies the first red data signal (R1) to the odd-numbered data line (DLo) through the first switch (S1) which is turned-on in accordance with the switch-on period (Son) of the first data selection signal (DSS1). And, according as the scan control signal (SCS4*i*−3) of the transistor-on period is supplied to the (4i−3)th scan control line, the first green data signal (G1) charged in the even-numbered data line (DLe) is supplied to the pixel circuit (PC) of the pixel (P) connected with the even-numbered data line (DLe), and the first red data signal (R1) supplied from the data distribution circuit 500 to the (4j−3)th data line (DL4*j*−3) is supplied to the pixel circuit (PC) of the pixel (P) connected with the odd-numbered data line (DLo), at the same time.

Then, in the first time-division period (TP1) of the (4i−2)th horizontal period (H4*i*−2), the column driving circuit 400 outputs the third red data signal (R3) to be supplied to the first color pixels (R) arranged in the (4j−1)th horizontal line (HL4*j*−1) through each output channel (CH), and the data distribution circuit 500 supplies the third red data signal (R3) to the odd-numbered data line (DLo) through the first switch (S1) which maintains the turning-on state in accordance with the switch-on period (Son) of the first data selection signal (DSS1). That is, the column driving circuit 400 continuously outputs the first red data signal (R1) and the third red data signal (R3) indicating the same color in the second time-division period (TP2) of the (4i−3)th horizontal period (H3*i*−2) and the first time-division period (TP1) of the (4i−2)th horizontal period (H4*i*−2). Accordingly, the third red data signal (R3) is charged in the line capacitance of the odd-numbered data line (DLo). In the first time-division period (TP1) of the (4i−2)th horizontal period (H4*i*−2), the scan control signal (SCS4*i*−1) supplied to the (4i−1)th scan control line is maintained as the transistor-off period.

Then, in the second time-division period (TP2) of the (4i−2)th horizontal period (H4*i*−2), the column driving circuit 400 outputs the third green data signal (G3) to be supplied to the second color pixels (G) arranged in the (4j−1)th horizontal line (HL4*j*−1) through each output channel (CH), and the data distribution circuit 500 supplies the third green data signal (G3) to the even-numbered data line (DLe) through the second switch (S2) which is turned-on in accordance with the switch-on period (Son) of the second data selection signal (DSS2). And, according as the scan control signal (SCS4*i*−2) of the transistor-on period is supplied to the (4i−1)th scan control line, the third red data signal (R3) charged in the odd-numbered data line (DLo) is supplied to the pixel circuit (PC) of the pixel (P) connected with odd-numbered data line (DLo), and the third green data signal (G3) supplied from the data distribution circuit 500 to the even-numbered data line (DLe) is supplied to the pixel circuit (PC) of the pixel (P) connected with the even-numbered data line (DLe), at the same time.

Then, in the first time-division period (TP1) of the (4i−1)th horizontal period (H4*i*−1), the column driving circuit 400 outputs the second green data signal (G2) to be supplied to the second color pixels (G) arranged in the (4j−2)th horizontal line (HL4*j*−2) through each output channel (CH), and the data distribution circuit 500 supplies the second green data signal (G2) to the even-numbered data line (DLe) through the second switch (S2) which maintains the turning-on state in accordance with the switch-on period (Son) of the second data selection signal (DSS2). That is, the column driving circuit 400 continuously outputs the third green data signal (G3) and the second green data signal (G2) indicating the same color in the second time-division period (TP2) of the (4i−2)th horizontal period (H4*i*−2) and the first time-division period (TP1) of the (4i−1)th horizontal period (H4*i*−1). Accordingly, the second green data signal (G2) is charged in the line capacitance of the even-numbered data line (DLe). In the first time-division period (TP1) of the (4i−1)th horizontal period (H4*i*−1), the scan control signal (SCS4*i*−2) supplied to the (4i−2)th scan control line is maintained as the transistor-off period.

Then, in the second time-division period (TP2) of the (4i−1)th horizontal period (H4*i*−1), the column driving circuit 400 outputs the first blue data signal (B1) to be supplied to the third color pixels (B) arranged in the (4j−2)th horizontal line (HL4*j*−2) through each output channel (CH), and the data distribution circuit 500 supplies the first blue data signal (B1) to the odd-numbered data line (DLo) through the first switch (S1) which is turned-on in accordance with the switch-on period (Son) of the first data selection signal (DSS1). And, according as the scan control signal (SCS4*i*−2) of the transistor-on period is supplied to the (4i−2)th scan control line, the second green data signal (G2) charged in the even-numbered data line (DLe) is supplied to the pixel circuit (PC) of the pixel (P) connected with the even-numbered data line (DLe), and the first blue data signal (B1) supplied from the data distribution circuit 500 to the odd-numbered data line (DLo) is supplied to the pixel circuit (PC) of the pixel (P) connected with the odd-numbered data line (DLo), at the same time.

Then, in the first time-division period (TP1) of the (4i)th horizontal period (H4*i*), the column driving circuit 400 outputs the second blue data signal (B2) to be supplied to the third color pixels (B) arranged in the (4j)th horizontal line (HL4*j*) through each output channel (CH), and the data distribution circuit 500 supplies the second blue data signal (B2) to the odd-numbered data line (DLo) through the first switch (S1) which maintains the turning-on state in accordance with the switch-on period (Son) of the first data selection signal (DSS1). That is, the column driving circuit 400 continuously outputs the first blue data signal (B1) and the second blue data signal (B2) indicating the same color in the second time-division period (TP2) of the (4i−1)th horizontal period (H4*i*−1) and the first time-division period (TP1) of the (4i)th horizontal period (H4*i*). Accordingly, the second blue data signal (B2) is charged in the line capacitance of the odd-numbered data line (DLo). In the first time-division period (TP1) of the (4i)th horizontal period (H4*i*), the scan control signal (SCS4*i*) supplied to the (4i)th scan control line is maintained as the transistor-off period.

Then, in the second time-division period (TP2) of the (4i)th horizontal period (H4*i*), the column driving circuit 400 outputs the fourth green data signal (G4) to be supplied to the second color pixels (G) arranged in the (4j)th horizontal line (HL4*j*) through each output channel (CH), and the data distribution circuit 500 supplies the fourth green data signal (G4) to the even-numbered data line (DLe) through the second switch (S2) which is turned-on in accordance with the switch-on period (Son) of the second data selection signal (DSS2). Accordingly, as the scan control signal (SCS4*i*) of the transistor-on period is supplied to the (4i)th scan control line, the second blue data signal (B2) charged in the odd-numbered data line (DLo) is supplied to the pixel circuit (PC) of the pixel (P) connected with the odd-numbered data line (DLo), and the fourth green data signal (G4) supplied from the data distribution circuit 500 to the even-numbered data line (DLe) is supplied to the pixel circuit (PC) of the pixel (P) connected with the even-numbered data line (DLe), at the same time.

Meanwhile, the aforementioned display apparatus according to the embodiment of the present disclosure shows the emission-type display apparatus including the emission device, but not limited to this structure. The display apparatus according to the present disclosure can be applied to a flat-type display apparatus such as a liquid crystal display apparatus as well as the emission-type display apparatus.

The display apparatus according to examples of the present disclosure can be explained as follows.

According to an embodiment of the present disclosure, a display apparatus comprises a display portion including pixels arranged in pixel areas defined by row line groups and column line groups, a row driving circuit configured to supply a scan control signal to the row line groups, a column driving circuit configured to sequentially output a data signal every horizontal period, and a data distribution circuit configured to sequentially supply the data signal, which is sequentially output from each of output channels of the column driving circuit, to the column line groups in accordance with a data selection signal, wherein a period of the data selection signal is longer than 1 horizontal period.

According to one or more embodiments of the present disclosure, the column driving circuit can sequentially output a first data signal and a second data signal to be supplied to the pixels for displaying different colors every horizontal period, and the second data signal of the (i)th horizontal period (herein, 'i' is a natural number) and the first data signal of the (i+1)th horizontal period can be sequentially supplied to the pixels disposed in the different horizontal lines and configured to display the same color.

According to the embodiment of the present disclosure, a display apparatus comprises a display portion including pixels arranged in pixel areas defined by row line groups and column line groups, a row driving circuit configured to supply a scan control signal to the row line groups, a column driving circuit configured to sequentially output a first data signal and a second data signal to the pixels configured to display different color every horizontal period, and a data distribution circuit configured to sequentially supply the first data signal and the second data signal, which are sequentially output from each of output channels of the column driving circuit, to the two column line groups, wherein the second data signal of the (i)th horizontal period (herein, 'i' is a natural number) and the first data signal of the (i+1)th horizontal period are continuously supplied to the pixels disposed in the different horizontal lines and configured to display the same color, and the data distribution circuit sequentially supplies the second data signal of the (i)th horizontal period and the first data signal of the (i+1)th horizontal period to any one of the two column line groups.

According to one or more embodiments of the present disclosure, a period of a data selection signal can be longer than 1 horizontal period.

According to one or more embodiments of the present disclosure, the data distribution circuit can include a plurality of demultiplex circuits configured to sequentially supply the first data signal and the second data signal, which are sequentially provided from the output channels of the column driving circuit, to the two column line groups in accordance with the data selection signal.

According to one or more embodiments of the present disclosure, the horizontal period can include a first time-division period, and a second time-division period which is longer than the first time-division period, and the column driving circuit can output the first data signal in the first time-division period, and output the second data signal in the second time-division period.

According to one or more embodiments of the present disclosure, the scan control signal can be supplied for the second time-division period.

According to one or more embodiments of the present disclosure, the data selection signal can include the first data selection signal, and the second data selection signal which is different from the first data selection signal, and each of the plurality of demultiplex circuits can include an input line connected with the corresponding output channel among the output channels of the column driving circuit, first and second output lines connected with the two column line groups in a one-to-one correspondence, a first switch which is turned-on by the first data selection signal of the data selection signal, and outputs the first data signal, which is supplied through the input line, to the first output line, and a second switch which is turned-on by the second data selection signal of the data selection signal, and outputs the second data signal, which is supplied through the input line, to the second output line.

According to one or more embodiments of the present disclosure, each of the first data selection signal and the second data selection signal can include a switch-on period configured to maintain a switch-on voltage level, and a switch-off period configured to maintain a switch-off voltage level, the scan control signal includes a transistor-on period configured to maintain a transistor-on voltage level, and a transistor-off period configured to maintain a transistor-off voltage level, and the transistor-on period of the scan control signal is shorter than the switch-on period in each of the first data selection signal and the second data selection signal.

According to one or more embodiments of the present disclosure, the transistor-on period of the scan control signal can be overlapped with the switch-off period of the first data selection signal and the switch-on period of the second data selection signal.

According to one or more embodiments of the present disclosure, each of the first data selection signal and the second data selection signal can include a first transition start point at which a transition from the switch-on voltage level to the switch-off voltage level is started, and a second transition start point at which a transition from the switch-off voltage level to the switch-on voltage level is started, the second transition start point of the first data selection signal can be overlapped with the switch-off period of the second data selection signal, and the second transition start point of the second data selection signal can be overlapped with the switch-off period of the first data selection signal.

According to one or more embodiments of the present disclosure, each of the first data selection signal and the second data selection signal can include a first transition start point at which a transition from the switch-on voltage level to the switch-off voltage level is started, and a second transition start point at which a transition from the switch-off voltage level to the switch-on voltage level is started, the scan control signal can include a first transition start point at which a transition from the transistor-off voltage level to the transistor-on voltage level is started, and a second transition start point at which a transition from the transistor-on voltage level to the transistor-off voltage level is started, and the first transition start point of the scan control signal can have a predetermined time difference from the second transition start point of the first data selection signal or the second transition start point of the second data selection signal.

According to one or more embodiments of the present disclosure, the first transition start point of the scan control signal can be delayed from the second transition start point of the first data selection signal, or a start point after a second transition completion point of the second data selection signal.

According to one or more embodiments of the present disclosure, the display portion can include a plurality of horizontal lines having first to third color pixels, the first color pixels can be connected with the (3j−2)th column line (herein, T is a natural number) among the column line groups in each of the plurality of horizontal lines, the second color pixels can be connected with the (3j−1)th column line among the column line groups in each of the plurality of horizontal lines, and the third color pixels can be connected with the (3j)th column line among the column line groups in each of the plurality of horizontal lines.

According to one or more embodiments of the present disclosure, the display portion can include a plurality of horizontal lines having first to third color pixels, the first color pixels can be connected with the (4j−3)th column line among the plurality of column line groups in each of the (4j−3)th horizontal line (herein, 'j' is a natural number) and the (4j−2)th horizontal line among the plurality of horizontal lines, and are connected with the (4j−1)th column line among the plurality of column line groups in each of the (4j−1)th horizontal line and the (4j)th horizontal line among the plurality of horizontal lines, the second color pixels can be connected with each of the (4j−2)th column line and the (4j)th column line among the plurality of column line groups in each of the plurality of horizontal lines, and the third color pixels can be connected with the (4j−1)th column line in each of the (4j−3)th horizontal line and the (4j−2)th horizontal line, and are connected with the (4j−3)th column line in each of the (4j−1)th horizontal line and the (4j)th horizontal line.

According to one or more embodiments of the present disclosure, the display portion can include a plurality of horizontal lines, wherein the odd-numbered horizontal line among the plurality of horizontal lines can include first color pixels connected with the odd-numbered column line of the column line groups, and second color pixels connected with the even-numbered column line of the column line groups, and the even-numbered horizontal line among the plurality of horizontal lines can include third color pixels connected with the odd-numbered column line, and the second color pixels connected with the even-numbered column line of the column line groups.

According to one or more embodiments of the present disclosure, the column driving circuit can sequentially output the first data signal and the second data signal to be supplied to the pixels arranged in the (4j−3)th horizontal line among the plurality of horizontal lines for the (4i−3)th horizontal period among the plurality of horizontal periods corresponding to the driving in each of the plurality of horizontal lines, the column driving circuit can sequentially output the first data signal and the second data signal to be supplied to the pixels arranged in the (4j−1)th horizontal line among the plurality of horizontal lines for the (4i−2) th horizontal period among the plurality of horizontal periods, the column driving circuit can sequentially output the first data signal and the second data signal to be supplied to the pixels arranged in the (4j−2)th horizontal line among the plurality of horizontal lines for the (4i−1) th horizontal period among the plurality of horizontal periods, and the column driving circuit can sequentially output the first data signal and the second data signal to be supplied to the pixels arranged in the (4j)th horizontal line among the plurality of horizontal lines for the (4i) th horizontal period among the plurality of horizontal periods.

According to one or more embodiments of the present disclosure, each of the plurality of horizontal periods can include a first time-division period, and a second time-division period which is longer than the first time-division period, wherein the row driving circuit can supply the scan control signal to the pixels arranged in the (4j−3)th horizontal line for the second time-division period of the (4i−3)th horizontal period, the row driving circuit can supply the scan control signal to the pixels arranged in the (4j−1)th horizontal line for the second time-division period of the (4i−2)th horizontal period, the row driving circuit can supply the scan control signal to the pixels arranged in the (4j−2)th horizontal line for the second time-division period of the (4i−1)th horizontal period, and the row driving circuit can supply the scan control signal to the pixels arranged in the (4j)th horizontal line for the second time-division period of the (4i)th horizontal period.

It will be apparent to those skilled in the art that the present disclosure described above is not limited by the above-described embodiments and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display apparatus comprising:

a display portion including pixels in pixel areas defined by row line groups and column line groups;

a row driving circuit configured to supply a scan control signal to the row line groups;

a column driving circuit configured to sequentially output a data signal every horizontal period; and a data distribution circuit configured to sequentially supply the data signal, which is sequentially output from each of output channels of the column driving circuit, to the column line groups in accordance with a data selection signal, wherein a period of the data selection signal is longer than one (1) horizontal period, wherein each of the horizontal periods includes a first time-division period and a second time-division period, wherein the data selection signal includes a switch-on period and a switch-off period, and wherein the switch-on period of the data selection signal overlaps the second time-division period of an (i)th horizontal period and the first time-division period of an (i+1)th horizontal period, where 'i' is a natural number.

2. The display apparatus according to claim 1, wherein a period of the data selection signal corresponds to two (2) horizontal periods.

3. The display apparatus according to claim 2, wherein the column driving circuit sequentially outputs a first data signal and a second data signal to be supplied to the pixels for displaying different colors every horizontal period, and the second data signal of the (i)th horizontal period and the first data signal of the (i+1)th horizontal period are sequentially supplied to the pixels disposed in the different horizontal lines and configured to display the same color.

4. The display apparatus according to claim 3, wherein the data distribution circuit includes a plurality of demultiplex circuits configured to sequentially supply the first data signal and the second data signal, which are sequentially provided from the output channels of the column driving circuit, to the two column line groups.

5. The display apparatus according to claim 1, wherein the display portion includes a plurality of horizontal lines having first to third color pixels, the first color pixels are connected with the (3j−2)th column line among the column line groups in each of the plurality of horizontal lines, where 'j' is a natural number, the second color pixels are connected with the (3j−1)th column line among the column line groups in each of the plurality of horizontal lines, and the third color pixels are connected with the (3j)th column line among the column line groups in each of the plurality of horizontal lines.

6. The display apparatus according to claim 1, wherein the display portion includes a plurality of horizontal lines having first to third color pixels, the first color pixels are connected with the (4j−3)th column line among the plurality of column line groups in each of the (4j−3)th horizontal line and the (4j−2)th horizontal line among the plurality of horizontal lines, and are connected with the (4j−1)th column line among the plurality of column line groups in each of the (4j−1)th horizontal line and the (4j)th horizontal line among the plurality of horizontal lines, where 'j' is a natural number, the second color pixels are connected with each of the (4j−2)th column line and the (4j)th column line among the plurality of column line groups in each of the plurality of horizontal lines, and the third color pixels are connected with the (4j−1)th column line in each of the (4j−3)th horizontal line and the (4j−2)th horizontal line, and are connected with the (4j−3)th column line in each of the (4j−1)th horizontal line and the (4j)th horizontal line.

7. The display apparatus according to claim 1, wherein the display portion includes a plurality of horizontal lines, wherein the odd-numbered horizontal line among the plurality of horizontal lines includes first color pixels connected with the odd-numbered column line of the column line groups, and second color pixels connected with the even-numbered column line of the column line groups, and the even-numbered horizontal line among the plurality of horizontal lines includes third color pixels connected with the odd-numbered column line, and the second color pixels connected with the even-numbered column line of the column line groups.

8. The display apparatus according to claim 7, wherein the column driving circuit sequentially outputs a first data signal and a second data signal to be supplied to the pixels arranged in the (4j−3)th horizontal line among the plurality of horizontal lines for the (4i−3)th horizontal period among the plurality of horizontal periods corresponding to the driving in each of the plurality of horizontal lines, where 'i' and 'j' are natural numbers, the column driving circuit sequentially outputs the first data signal and the second data signal to be supplied to the pixels arranged in the (4j−1)th horizontal line among the plurality of horizontal lines for the (4i−2) th horizontal period among the plurality of horizontal periods, the column driving circuit sequentially outputs the first data signal and the second data signal to be supplied to the pixels arranged in the (4j−2)th horizontal line among the plurality of horizontal lines for the (4i−1) th horizontal period among the plurality of horizontal periods, and the column driving circuit sequentially outputs the first data signal and the second data signal to be supplied to the pixels arranged in the (4j)th horizontal line among the plurality of horizontal lines for the (4i) th horizontal period among the plurality of horizontal periods.

9. The display apparatus according to claim 8, wherein the second time-division period to output the first data signal is longer than the first time-division period to output the second data signal, wherein the row driving circuit supplies the scan control signal to the pixels arranged in the (4j−3)th horizontal line for the second time-division period of the (4i−3)th horizontal period, the row driving circuit supplies the scan control signal to the pixels arranged in the (4j−1)th horizontal line for the second time-division period of the (4i−2)th horizontal period, the row driving circuit supplies the scan control signal to the pixels arranged in the (4j−2)th horizontal line for the second time-division period of the (4i−1)th horizontal period, and the row driving circuit supplies the scan control signal to the pixels arranged in the (4j)th horizontal line for the second time-division period of the (4i)th horizontal period.

10. The display apparatus according to claim 1, wherein the switch-on period of the data selection signal is longer than the second time-division period and is shorter than the one (1) horizontal period.

11. A display apparatus comprising:

a display portion including pixels arranged in pixel areas defined by row line groups and column line groups;

a row driving circuit configured to supply a scan control signal to the row line groups;

a column driving circuit configured to sequentially output a first data signal and a second data signal to the pixels configured to display different color every horizontal period; and a data distribution circuit configured to sequentially supply the first data signal and the second data signal, which are sequentially output from each of output channels of the column driving circuit, to the two column line groups in accordance with a data selection signal, wherein the second data signal of an (i)th horizontal period and the first data signal of an (i+1)th horizontal period are sequentially supplied to the pixels disposed in the different horizontal lines and configured to display the same color, where 'i' is a natural number, wherein the data distribution circuit continuously supplies the second data signal of the (i)th horizontal period and the first data signal of the (i+1)th horizontal period to any one of the two column line groups, wherein each of the horizontal periods includes a first time-division period to output the first data signal and a second time-division period to output the second data signal, wherein the data selection signal includes a switch-on period and a switch-off period, and wherein the switch-on period of the data selection signal overlaps the second time-division period of the (i)th horizontal period and the first time-division period of the (i+1)th horizontal period.

12. The display apparatus according to claim 11, wherein a period of the data selection signal is longer than one (1) horizontal period.

13. The display apparatus according to claim 12, wherein the data distribution circuit includes a plurality of demultiplex circuits configured to sequentially supply the first data signal and the second data signal, which are sequentially provided from the output channels of the column driving circuit, to the two column line groups in accordance with the data selection signal.

14. The display apparatus according to claim 13, wherein the second time-division period is longer than the first time-division period, and the column driving circuit outputs the first data signal in the first time-division period, and outputs the second data signal in the second time-division period.

15. The display apparatus according to claim 14, wherein the scan control signal is supplied in the second time-division period.

16. The display apparatus according to claim 13, wherein the data selection signal includes a first data selection signal, and a second data selection signal which is different from the first data selection signal, and each of the plurality of demultiplex circuits includes:

an input line connected with the corresponding output channel among the output channels of the column driving circuit;

first and second output lines connected with the two column line groups in a one-to-one correspondence;

a first switch which is turned-on by the first data selection signal of the data selection signal, and outputs the first data signal, which is supplied through the input line, to the first output line; and a second switch which is turned-on by the second data selection signal of the data selection signal, and outputs the second data signal, which is supplied through the input line, to the second output line.

17. The display apparatus according to claim 16, wherein each of the first data selection signal and the second data selection signal includes the switch-on period configured to maintain a switch-on voltage level, and the switch-off period configured to maintain a switch-off voltage level, the scan control signal includes a transistor-on period configured to maintain a transistor-on voltage level, and a transistor-off period configured to maintain a transistor-off voltage level, and the transistor-on period of the scan control signal is shorter than the switch-on period in each of the first data selection signal and the second data selection signal.

18. The display apparatus according to claim 17, wherein the transistor-on period of the scan control signal is overlapped with the switch-off period of the first data selection signal and the switch-on period of the second data selection signal.

19. The display apparatus according to claim 17, wherein each of the first data selection signal and the second data selection signal includes a first transition start point at which a transition from the switch-on voltage level to the switch-off voltage level is started, and a second transition start point at which a transition from the switch-off voltage level to the switch-on voltage level is started, the second transition start point of the first data selection signal is overlapped with the switch-off period of the second data selection signal, and the second transition start point of the second data selection signal is overlapped with the switch-off period of the first data selection signal.

20. The display apparatus according to claim 17, wherein each of the first data selection signal and the second data selection signal includes a first transition start point at which a transition from the switch-on voltage level to the switch-off voltage level is started, and a second transition start point at which a transition from the switch-off voltage level to the switch-on voltage level is started, the scan control signal includes a first transition start point at which a transition from the transistor-off voltage level to the transistor-on voltage level is started, and a second transition start point at which a transition from the transistor-on voltage level to the transistor-off voltage level is started, and the first transition start point of the scan control signal has a predetermined time difference from the second transition start point of the first data selection signal or the second transition start point of the second data selection signal.

21. The display apparatus according to claim 20, wherein the first transition start point of the scan control signal is delayed from the second transition start point of the first data selection signal, or a start point after a second transition completion point of the second data selection signal.

22. The display apparatus according to claim 11, wherein the switch-on period of the data selection signal is longer than the second time-division period and is shorter than one (1) horizontal period.

* * * * *